US007409845B2

(12) United States Patent
Schill et al.

(10) Patent No.: US 7,409,845 B2
(45) Date of Patent: Aug. 12, 2008

(54) QUICK CHANGE OVER APPARATUS FOR MACHINE LINE

(75) Inventors: Joseph G. Schill, Lynchburg, VA (US); Jeffery Lee Shortridge, Lynchburg, VA (US); Christopher D. Shuey, Fishersville, VA (US); Dennis Green, Johns Island, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 0 days.

(21) Appl. No.: 11/843,398

(22) Filed: Aug. 22, 2007

(65) Prior Publication Data

US 2007/0283665 A1 Dec. 13, 2007

Related U.S. Application Data

(62) Division of application No. 11/126,151, filed on May 11, 2005.

(60) Provisional application No. 60/628,562, filed on Nov. 18, 2004.

(51) Int. Cl.
*B21D 11/10* (2006.01)

(52) U.S. Cl. ..... 72/379.4; 72/94; 72/481.6; 72/481.7

(58) Field of Classification Search ..... 72/94, 72/379.4, 405.03, 446, 481.6, 482.2, 482.6, 72/715, 481.3, 481.7, 481.8
See application file for complete search history.

(56) References Cited

U.S. PATENT DOCUMENTS 2,940,502 A * 6/1960 La Martine ..... 72/105
3,406,648 A 10/1968 Armbruster
3,418,837 A 12/1968 Dirk et al.
3,599,780 A 8/1971 Sorbie
3,687,098 A 8/1972 Maytag
3,983,729 A * 10/1976 Traczyk et al. ..... 72/43
4,164,997 A 8/1979 Mueller
4,341,103 A 7/1982 Escallon et al.
4,590,788 A 5/1986 Wallis (Continued)

FOREIGN PATENT DOCUMENTS

EP 0 885 076 7/2002

(Continued)

OTHER PUBLICATIONS

Belvac Products—Necking Systems, 595K/SK Modular Necking Systems [online], [retrieved on Nov. 30, 2005], 3 pages. Retrieved from the Internet: <URL: http://www.belva.com/products/necking1.asp>.

(Continued)

*Primary Examiner*—Edward Tolan
(74) *Attorney, Agent, or Firm*—Foley & Lardner LLP

(57) ABSTRACT

A machine arrangement includes a plurality of machines arranged to cooperate with each other in a manner which comprises a machine line. This machine line incorporates apparatus which is associated with and/or comprises part of the machines for: at least one of moving, holding, manipulating and shaping cans as they pass from a can infeed to a can discharge of the machine line and move along a path having a predetermined configuration. This apparatus minimizes operations necessary for changing from a set up suitable for modifying a can having a first set of dimensions to a set up suitable for a can having a second set of dimensions.

8 Claims, 39 Drawing Sheets

U.S. PATENT DOCUMENTS 4,671,093 A 6/1987 Dominico et al.
4,693,108 A * 9/1987 Traczyk et al. ..... 72/370.02
4,817,409 A 4/1989 Bauermeister
4,838,064 A 6/1989 Paess
5,235,839 A 8/1993 Lee et al.
5,245,848 A 9/1993 Lee et al.
5,282,375 A 2/1994 Lee et al.
5,349,836 A 9/1994 Lee
5,353,619 A 10/1994 Chu et al.
5,467,628 A 11/1995 Bowlin et al.
5,540,320 A 7/1996 Sarto et al.
5,553,826 A 9/1996 Schultz
5,611,231 A 3/1997 Marritt et al.
5,634,364 A 6/1997 Gardner et al.
5,676,006 A 10/1997 Marshall
5,713,235 A 2/1998 Diekhoff
5,755,130 A 5/1998 Tung et al.
5,782,308 A * 7/1998 Latten et al. ..... 72/481.6
6,032,502 A 3/2000 Halasz et al.
6,085,563 A 7/2000 Heiberger et al.
6,167,743 B1 1/2001 Marritt et al.
6,178,797 B1 1/2001 Marshall et al.
6,199,420 B1 3/2001 Bartosch
6,240,760 B1 6/2001 Heiberger et al.
6,571,986 B1 6/2003 Simmons
6,658,913 B1 12/2003 Zanzerl et al.
6,661,020 B2 12/2003 Schill et al.
6,698,265 B1 3/2004 Thomas
6,752,000 B2 6/2004 Reynolds et al.
7,028,857 B2 4/2006 Peronek
7,069,765 B2 * 7/2006 Grove et al. ..... 72/481.1
7,100,417 B2 9/2006 Yamanaka et al.
2005/0193796 A1 9/2005 Heiberger et al.
2006/0101884 A1 5/2006 Schill et al.
2006/0101885 A1 5/2006 Schill et al.
2006/0101889 A1 5/2006 Schill et al.
2006/0104745 A1 5/2006 Schill et al.
2007/0283544 A1 12/2007 Schill et al.

FOREIGN PATENT DOCUMENTS

WO WO 97/37786 10/1997

OTHER PUBLICATIONS

Belvac Production Machinery, Technical Bulletin, Aug. 2004, 1 page, vol. 7, Issue 07.
U.S. Appl. No. 11/126,146, filed May 11, 2005, Joseph G. Schill et al.
U.S. Appl. No. 11/126,151, filed May 11, 2005, Joseph G. Schill et al.
U.S. Appl. No. 11/126,152, filed May 11, 2005, Joseph G. Schill et al.

* cited by examiner

QUICK CHANGE OVER APPARATUS FOR MACHINE LINE

This application is a Divisional of U.S. application Ser. No. 11/126,151, filed May 11, 2005, which claims priority to Provisional Application No. 60/628,562 filed Nov. 18, 2004. The entire content of the aforementioned applications are incorporated herein by reference

FIELD OF THE INVENTION

The present invention relates generally to series of machines or machine units which constitute a machine line, and more specifically to apparatus which forms part of the machines and which enables the line to be quickly switched between a first set-up wherein a first sized product is modified/manufactured and at least one other set-up wherein a different dimensioned product is modified/manufactured.

BACKGROUND OF THE INVENTION

Necking machines have been used to form the neck on beer and beverage cans and the like for some time. These machines have evolved to the degree that reliable high speed precision necking is reliably realized. However, a drawback is encountered when switching from a run of one sized can to another, in that the downtime tends to be considerable. That is to say, the change-over requires the switching of an extensive number of elements and replacing them with new elements and/or re-adjusting current element to accommodate either the new diameter or length of the next can to be necked. Merely by way of example, with a change in diameter or neck profile, the current series of dies and knockout punches on each of the turrets needs to be changed. Transfer starwheels which temporarily hold, and then transfer cans to turret starwheels during their serpentine travel through the line or battery of necking turrets, need to be changed for a change in diameter and/or repositioned for a change in length, or both, if the can is both longer and different in diameter. The turret starwheels likewise must be changed with a change in diameter.

The close proximity of the turrets and the serpentine path along which the cans are conveyed, introduces problems such that, merely by way of example, when it is necessary to change over the dies, only two or three of these dies are accessibly exposed at the top of the turret on which they are supported, the remaining dies remaining between or below the turrets and thus totally inaccessible to an operator. This necessitates that an operator or operators, charged with the task of changing over these elements, change those which are exposed and rendered accessible, and then jog the machines to rotate the rotatable elements on each of the turrets to positions wherein the next two or three elements are rendered accessible. These dies are usually attached with a threaded collar and require a number of rotations to thread/unthread. This of course is inevitably carried out by hand.

In the event that twelve elements are carried per turret and there are 12-14 turrets involved in the necking process, no less than 168 operations are necessary. Thus, if it takes, for example, just 3 minutes on average to release one die and replace it with another and secure the new die in position, it will take at least 8 man hours to simply change over the dies on the aligned series of turrets. Accordingly, as will be understood, any change in change-over time is multiplied significantly.

Of course, this is merely the tip of the iceberg and, at least in addition to the above, it is necessary to replace/relocate (in the case of a change of diameter/length) the starwheels which respectively transport and position the cans for the sequence of necking operations necessary in order to achieve the required neck profile. It is also necessary to painstakingly set each of the can handling starwheels with respect to those on either side, so that can hand-off is carried out precisely and smoothly and without damage to cans.

Thus, to be able to reduce this non-productive labor intensive downtime, is highly desirable.

SUMMARY OF THE INVENTION

In order to quickly change over from the production of one type of can to another wherein the new can features one or more of a different diameter, length, neck profile, the machine line which comprises a series of turret machines incorporates apparatus (devices/arrangements) which reduce the number of operations/time necessary to condition the line to the degree that a new set up is achieved.

For example, in order to accommodate a can having a different length, either the turret which is configured to carry the rams which carry/drive the push plates, or the turret which carries the dies/knockout rams, is arranged to be movable with respect to the corresponding turret which carries the other of the push plate/rams, and dies/knockout rams. This allows the movable turret to be moved toward or away from the other (the stationary turret) to allow for the difference in length and obviates the need to change each of the push plates to allow for the different length can. This immediately reduces 10-16 time consuming operations per turret machine.

Further, in this embodiment, the turret starwheel is comprised of two individual segments. Each segment is carried on a different turret so that, as the movable turret moves with respect to the stationary one, the distance between the two turret starwheel segments automatically adjusts and at least the need to interchange the turret starwheel and/or make any changes in connection therewith (in connection with a change in can length) is obviated. The lower guide which is associated with the turret starwheel segment that is associated with the movable turret, needs to be released and slid along its support shaft and then re-secured in a suitable position with respect to the movable segment of the turret starwheel. This lower guide is designed to facilitate the transfer of the cans which are carried on the transfer starwheels to the next turret starwheel.

In the case that the change in length of the can is such that the cans are longer and the center of gravity of the cans becomes located appreciably outside of the width of the transfer starwheels (which transfer cans between necking machines/modules), instead of replacing the transfer starwheels per se, an embodiment of the invention is such that the transfer starwheel is formed of first and second segments which can be secured together in a face-to-face relationship. To increase the width of the transfer starwheel, the second segment of the transfer starwheel is swapped for one which is wider and such as to renders the total width of the transfer starwheel such that the center of gravity of the can falls within its width and/or within normal transfer parameters. The first segment remains secured in place, obviating, for reasons that will become more clearly appreciated hereinlater, any need for inter-starwheel positional adjustment. This increase in width maintains the stability of the cans with respect to the centrifugal force which is applied as the transfer starwheel rotates and prevents can wobble and/or cans being lost from the transfer line.

In order to secure the cans in position when they are rotated to a position which is located below the axis of transfer starwheel rotation, the second transfer starwheel segment is provided with channel portions in the bottoms of the can receiving recesses or pockets, that are configured to register (viz., mate) with those formed in first or base segment. This provided an arrangement whereby the channels which function in a manner similar to "octopus suckers" are simply elongated or lengthened, thus allowing the application of suction along an elongated recess and stably holding the can in position.

In the case of a change in diameter, it is necessary to change both the transfer starwheels and the turret starwheels to ones which have can receiving recesses with the appropriate radii. In the past, this change over has required, as noted above, that each transfer starwheel and turret starwheel to be located with great precision with respect to the next so that the cans will be smoothly transferred from one wheel to the next and will be not be damaged or misshapen and will be positioned to be appropriately pushed into the necking dies. To speed up this process and to eliminate the need to re-synchronize all of the transfer starwheels and the turret starwheels with one another, timing plates are secured to the shafts which carry the transfer starwheels and the turret starwheels, and are precisely set with respect to one another. Thus, when the transfer starwheel and the turret starwheels are mounted on the respective timing plates, they are precisely located with respect to one another in the required manner and the need to adjust the rotational angle of one with respect to another is obviated. The turret starwheels are formed in two halves so that the can may be disposed in position about a main drive shaft which interconnects the movable and stationary turrets.

The timing plates are configured to have positioning pins (e.g. dowels) and the transfer starwheels and turret starwheels are formed with bored/reamed holes which are in precisely the same positions on each starwheels. Thus, after the first timing plate set up on each of the battery of turret modules, all that is necessary is to switch starwheels and bolt them in place. This eliminates the need to use can sized synchronizing tools/jigs which are conventionally used to locate the starwheels so that they are secured in position suitable for can hand-off/transfer.

In the case of a change in diameter, it is also necessary to change the dies and knockout punches. Conventionally, the dies are secured in position using threaded collars which are threaded and unthreaded by hand. It goes without saying that effecting the change by manually loosening and rotating each threaded collar of the old dies to the degree necessary to unthread each collar from its operative position, locate each new dies in position and then securing the new dies in position by again manually rotating a threaded collar into an operative position, is a time consuming task. This task is made doubly difficult in that, as it is done by hand, care must be taken not to drop the collars during this process.

An embodiment of the invention overcomes this by using pivotal clamps which each require only a single bolt to be loosened or tightened. This tightening/loosening can, of course, be carried out using a suitable power tool such as a pneumatically or electrically operated power tool. In accordance with this embodiment of the invention, each of the clamps is arranged to have two arcuate sections which each engage a portion of flanges on a pair of adjacent dies.

In an alternative embodiment, the clamp is not pivotally mounted and is removable. In this embodiment the clamp is held in position using one or more bolts. While both of these embodiments have two arcuate die engaging surfaces each, the invention is not so limited and it is within the scope of the inventive embodiments to have only one arcuate die engaging surface.

With the pivotal clamp embodiment of the invention, it is possible, by sliding the two dies into position, pivoting the clamp into position and then tightening a single bolt, which is accessibly located between the two dies, two adjacent dies can be secured in position. This, as will be best appreciated from FIG. 35 provides a $2\times\alpha$ clamping contact for each die. However, in the end, the number of the clamps equals the number of dies. The bolts can be tightened/loosened using a pneumatically powered tool as different from the manual rotation previously required.

In accordance with an embodiment of the pivotal clamps, the clamps are each provided with their own detent so that when they are released they can each be rotated back and temporarily held in the released position by the detent. This feature is such that when removing one set of dies, the cramped operating space renders it impossible to actually gain access to more than about three dies at a time. Thus, it is necessary to jog the turrets to rotate the next set of dies to a position wherein they are exposed to the degree that removal is enabled. To prevent confusion, as the dies are often the same or similar color, it is often preferred to remove all of one set of dies before disposing the new units in position. The detents permit the clamps to be pivoted and snapped into open positions which allow the turrets to be partially rotated (jogged) without fear of the clamps swinging out under the influence of the centrifugal force which is produced, and interfering with adjacent equipment in a manner which invites damage/breakage to either or both.

The infeed and discharge devices at the ends of the line need to be adjusted with respect to can length when the length of the can to be processed, is changed. Embodiments of the infeed and discharge arrangements facilitate this adjustment and are such that two halves of the structure include shafts on which they are mutually supported and along at least one of which the halves are slidable. Collars through which the shafts extend and which are supported on the structures (halves) can be selectively tightened/released such as through the use of a portable power tool, to allow for reconfiguration of the devices and to allow the width of the devices to be adjusted with respect to the length of a can which is about to be processed (necked).

In more specific terms, a first aspect of the invention resides in a machine arrangement comprising: a plurality of machines arranged to cooperate with each other in a manner which comprises a machine line; apparatus means associated with and/or comprising part of the machines for: at least one of moving, holding, manipulating and shaping cans as they pass from a can infeed to a can discharge of the machine line and move along a path having a predetermined configuration, and for minimizing operations necessary for changing from a set up suitable for modifying a can having a first set of dimensions to a set up suitable for a can having a second set of dimensions.

In the above machine line, the machines each comprise first and second turrets, and the apparatus means comprises: means for moving one of the first and second turrets with respect to the other whereby a distance between the turrets is adjustable with respect to a length of a can which is to be necked.

In this machine arrangement, the means for moving comprises a position adjusting drive mechanism which is selectively operable to reposition one of the first and second turrets with respect to the other. In one embodiment, the means for moving comprises a table immovably fixed to a machine chassis, the table cooperating with the drive mechanism so that the drive mechanism moves the support member along the table. The support member includes a locking mechanism for locking the support member to the table once suitable repositioning is achieved.

The above machine arrangement is such that one of the first and second turrets supports one of a) push plate and ram arrangements and b) necking dies and knockout ram arrangements, while the other of the first and second turrets supports the other of the a) push plate and ram arrangements and b) necking dies and knockout ram arrangements. The apparatus means, in this instance, comprises a turret starwheel arrangement which supports cans in a predetermined operative positions with respect to the first and second turrets and which, in one embodiment, comprises first and second separate segments which are respectively supported on the first and second turrets so that, as the distance between the first and second turrets is adjusted with respect to the length of a can to be necked, the distance between the first and second segments is simultaneously changed.

In this arrangement the predetermined operative positions are positions wherein they are aligned with respect to the a) push plate and ram arrangements and b) necking dies and knockout ram arrangements.

In a further embodiment, the apparatus means comprises a plurality of dies which are slidably disposed in position on a turret structure and a plurality of clamps which are secured to the turret structure by way of a plurality of bolts, each clamp having an engagement surface which engages a portion of each die and holds the dies on the turret structure. In a preferred embodiment, the plurality of clamps are each pivotally supported on the turret structure. This eliminates the possibility of droppage/loss and reduces the number of parts the operators are required to keep track of during the set up change.

Each of these pivotal clamps has a detent to hold the clamp in an open position wherein it is pivoted away from a position wherein the clamp holds at least one die in position on the turret structure. This conveniently secures them in place in the manner noted above. Each of the clamps is held on the turret structure by the above mentioned bolts.

In the above mentioned machine arrangement, each machine has at least first and second parallel, synchronously contra rotating shafts which respectively support a turret starwheel and a transfer starwheel. The turret starwheel and the transfer starwheel are arranged to pass cans therebetween and move the cans along a part of the path having the above-mentioned predetermined configuration. In this embodiment, the apparatus means comprises first and second timing plates or hubs wherein the first timing plate is associated with the first shaft and the second timing plate is associated with the second shaft.

Each of these timing plate is positionally adjustable with respect to, and then secured in place, on the shaft with which it is associated. The first timing plate interconnects one of the above-mentioned first and second turret starwheel segments with the first shaft while the second timing plate interconnects the transfer starwheel with the second shaft. The other of the first and second turret starwheel segments is connected directly to the first shaft without the interposition of a timing plate. This directly connected segment acts as a reference with respect to which the second segment and the transfer starwheel are timed.

These timing plates, once adjusted and fixed in their respective positions on the respective shafts, are such that the turret starwheel and the transfer starwheel can be respectively interchanged with a different turret starwheel and a different transfer wheel, and the positional arrangement of the timing plates on the shafts causes the positional relationship between the interchanged turret starwheel and the interchanged transfer starwheel to be the same as the positional relationship between the turret starwheel and the transfer starwheel before the interchange. This allows currently used starwheels to be removed and those having different diameter pockets to be mounted in position without any need for any time consuming positional adjustment.

Another embodiment is such that each of the previously mentioned machines has a drive shaft which supports an interchangeable starwheel that is configured to transport cans along a part of the path having the above-mentioned predetermined configuration. In this instance the apparatus means comprises a timing plate which is associated with the drive shaft. The timing plate is positionally adjustable with respect to, and then secured in place on, the drive shaft, and configured to connect a first interchangeable starwheel to the shaft in a manner wherein, when the first interchangeable starwheel is changed with a second interchangeable starwheel, the second starwheel assumes the same angular rotational relationship with respect to the drive shaft as the first starwheel which it replaces.

In the above mentioned embodiment, the second starwheel has can receiving recesses which are different in diameter with respect to the can receiving recesses of the first starwheel.

Further, each of the interchangeable starwheels comprises first and second segments. More specifically, the above mentioned machines each comprise first and second turrets and the first and second segments comprise separate segments of a turret starwheel arrangement where the first and second segments are respectively associated with the first and second turrets.

In one embodiment, the first and second segments are connectable to form a single unit. A plurality of add-on/replacement second segments are available. Each have a different width and an appropriate one can be selected in order to adjust a width of the single unit.

The first segment has a plurality of equidistantly spaced can receiving recesses about its periphery. Each recess is formed with a first portion of a vacuum channel. Each second segment is formed with a second portion of the vacuum channel. With this arrangement, each vacuum channel is completed when the first and second segments are secured together and the first and second portions of the vacuum channel are brought into register with one another.

Infeed and discharge devices are disposed at the upstream and downstream ends of the machine line. In this instance, the apparatus means comprises the infeed and discharge devices each comprising first and second halves which are operatively interconnected with one another so as to be selectively slidable toward and away from one another. In a specific embodiment, the two halves of each of the infeed and discharge devices are movably supported on each other by way of a plurality of shafts. Collars, such as split collars, through which the shafts extend, are fixed to the two halves and arranged to be selectively tightened/released to allow for the ready reconfiguration of the infeed and discharge devices.

The above machine arrangement includes an embodiment wherein the machines comprise at least in part, a plurality of machine modules and/or a plurality of machines which are mounted on a common chassis.

A further aspect of the above mentioned machine arrangement resides in that the first turret is moveable with respect to the second turret and wherein the first turret comprises: a cam support member; a cam supported stationarily on the cam support member; a support block which is rotatable with respect to the cam and connected with a drive shaft which operatively interconnects the first and second turrets for synchronous rotation therewith. In this instance, the apparatus means is embodied by a position adjusting drive mechanism which is selectively operable to reposition the first turret with respect to the second turret, and a shaft adjusting tool, which interconnects the cam support member and the support block during repositioning so that during repositioning when the first turret is moved with respect to the second turret by the position adjusting drive mechanism, the spatial relationship between the cam support member and the support block remains unchanged.

Another aspect of the invention resides in a lubricating arrangement for a movable turret of the above-mentioned nature. This lubricating arrangement includes an inlet port, an outlet port and a helically coiled tube fluidly interconnecting the inlet and outlet ports. The inlet port is formed in an axially stationary shaft which is driven to rotate and which extends essentially the length of the turret arrangement. The support structure on which the one of the push plate/ram arrangements and die and knockout ram arrangements are supported, is splined to the shaft for synchronous rotation therewith. The outlet port is associated with the support structure to supply lubricant to the one of the push plate/ram arrangements and die and knockout ram arrangements. The helically wound tube is disposed around the shaft. The shaft has a coaxial bore through which lubricant is supplied to the inlet port. The inlet port is formed in the shaft at a position which is located so that the movable turret is permitted to move between first and second travel limits along the shaft, and so that the helically wound tube stretches/contracts in a manner which maintains fluid communication between the inlet port and outlet port during movement between the first and second travel limits.

The cam support member in at least one embodiment houses a bearing that supports one end of a turret drive shaft which extends between the fixed and movable turrets in a manner which allows the cam support member to move axially with respect to the turret drive shaft. The movable turret further comprises a support block which is rotatable with respect to the cam and the cam support member, the support block being selectively connectable to the turret drive shaft for synchronous rotation therewith. In this embodiment, the support block is configured to support can necking apparatus which is operatively connected with the cam in a manner which induces reciprocal motion therein when the support block is rotated with respect to the cam. The can necking apparatus, in this instance, exemplarily comprises one of a plurality of push plate/ram arrangements and a plurality of die and knockout ram arrangements.

A further aspect of the invention resides in a method of quickly changing a product modification set-up comprising: color coding a plurality of parts which form a series of machines that cooperate to define a machine line, and which parts, at least in part, need to be changed/adjusted in order to change from one product modification set-up to another product modification set-up; changing color coded parts in accordance with the dictates of a change in dimensions of an item to be produced by the series of machines and thus effecting a change in product modification set-up.

Yet another aspect of the invention resides in a starwheel for use with a can necking machine comprising: a first segment configured to be connected to a drive shaft; a plurality of second segments each configure to be connectable to the first segment, each of the plurality of second segments having a different width so as to be selectable to produce, when connected to the first segment, a total width suitable for supporting a can having given length and diameter dimensions. The first segment in this instance has a plurality of can receiving recesses formed about its periphery, each of the recesses having a first channel portion formed in the bottom thereof, each of the first channel portions communicating with a source of negative pressure. Each second segment has a plurality of can receiving recesses formed about its periphery which are configured to register with the can receiving recesses formed in the first segment, each second segment having a second channel portion formed therein, each second channel portion being configured to register with a first channel portion and define a complete channel.

In this embodiment, the starwheel is a transfer starwheel which transfers cans from or to a turret starwheel associated with first and second turrets which are configured to support one of a) push plate and ram arrangements and b) necking dies and knockout ram arrangements respectively. The first turret is movable toward and away from the second turret and the turret starwheel comprises first and second separate turret segments wherein the first turret segment is operatively supported on the first turret and the second turret segment is supported on the second turret.

An additional aspect of the invention resided in a clamp for use with a can necking machine comprising: a pivotal member pivotal between a clamping position and a release position, the pivotal member having at least one arcuate clamping surface configured to engage a die and to secure the die in position on a die block. A mounting bracket is configured to be fastened to a die block. This bracket is configured to support the pivotal member so as to be pivotal about an axis. A fastening bolt is rotatably received in a through bore formed in the pivotal member and configured to thread into a tapped bore formed in one of the die block and a clamp mounting bracket secured to the die block, the through hole being configured to allow pivotal movement of the bolt in a manner wherein an axis of the bolt is pivotal through an angle which lies on a plane normal to the pivot axis about which the pivotal member is pivotal.

A further aspect of the invention resides in a timing plate for use in a can necking machine comprising: a plate which is configured to support a starwheel which transfer cans through the necking machine, the plate being adjustably connectable to a drive shaft associated with the starwheels so as to enable a starwheel to be replaced with another and to cause the another starwheel to assume exactly the same positional status as that which it replaces.

A yet further aspect of the invention resides in a method of changing a can necking machine line from a first can necking set up to a different can necking set up wherein the machine line comprises machines having a first turret which supports one of push plate and ram arrangements and die and knockout ram arrangements and a second turret which supports the other of the push plate and ram arrangements and die and knockout ram arrangements, which comprises the steps of: adjusting the set up for a change in can length by moving the first turret with respect to the second turret, and adjusting a distance between the push plates and the dies in accordance with a length of a can to be necked.

This method further includes: connecting a first turret starwheel segment to the first turret and connecting a second turret starwheel segment to the second turret so that a distance between the first and second starwheel segments turrets changes with a change in distance between the first and second turrets.

Another aspect of this method resides in synchronizing the rotational relationship between the first and second turret starwheel segments and transfer starwheels located on either side of the turret starwheel by: using timing plates which operatively interconnect the turret starwheel and transfer starwheels to their respective drive shafts, securing the timing plates to the respective drive shafts when the desired synchronization between the turret starwheel and transfer starwheels is achieved to allow turret starwheel and transfer starwheel replacement without the need again synchronize the turret starwheel and transfer starwheels again.

In addition to the above, it is also possible to adjust the width of a transfer starwheel by operatively connecting a first segment of the transfer starwheel to a transfer starwheel drive shaft, and connecting a second segment selected to have a width selected in accordance with a length of a can to be modified, to the first segment.

The above method can also include modifying the length of a vacuum channels formed in the transfer starwheel by forming a first channel portions in the first segment and second portions in the second segment and combining the first and second channel portions to form closed channels which can be elongated with the combined width of the first and second segments of the transfer starwheel.

Another aspect of the invention resides in a method of clamping necking dies in their respective operative positions using a clamp member and tightening the clamp by tightening a bolt. This includes mounting a mounting bracket on a block on which the die supported, and securing the clamp member to the mounting bracket using the bolt. In addition, the method features pivotally supporting the clamp on the bracket and holding the pivotally supported clamp in the open position using a detent.

BRIEF DESCRIPTION OF THE DRAWINGS

The various aspects and advantages of the embodiments of the invention will become more clearly appreciated as a detailed description of exemplary embodiments is given with reference to the appended drawings in which.

DETAILED DESCRIPTION OF THE EXEMPLARY EMBODIMENTS

Figure 1:
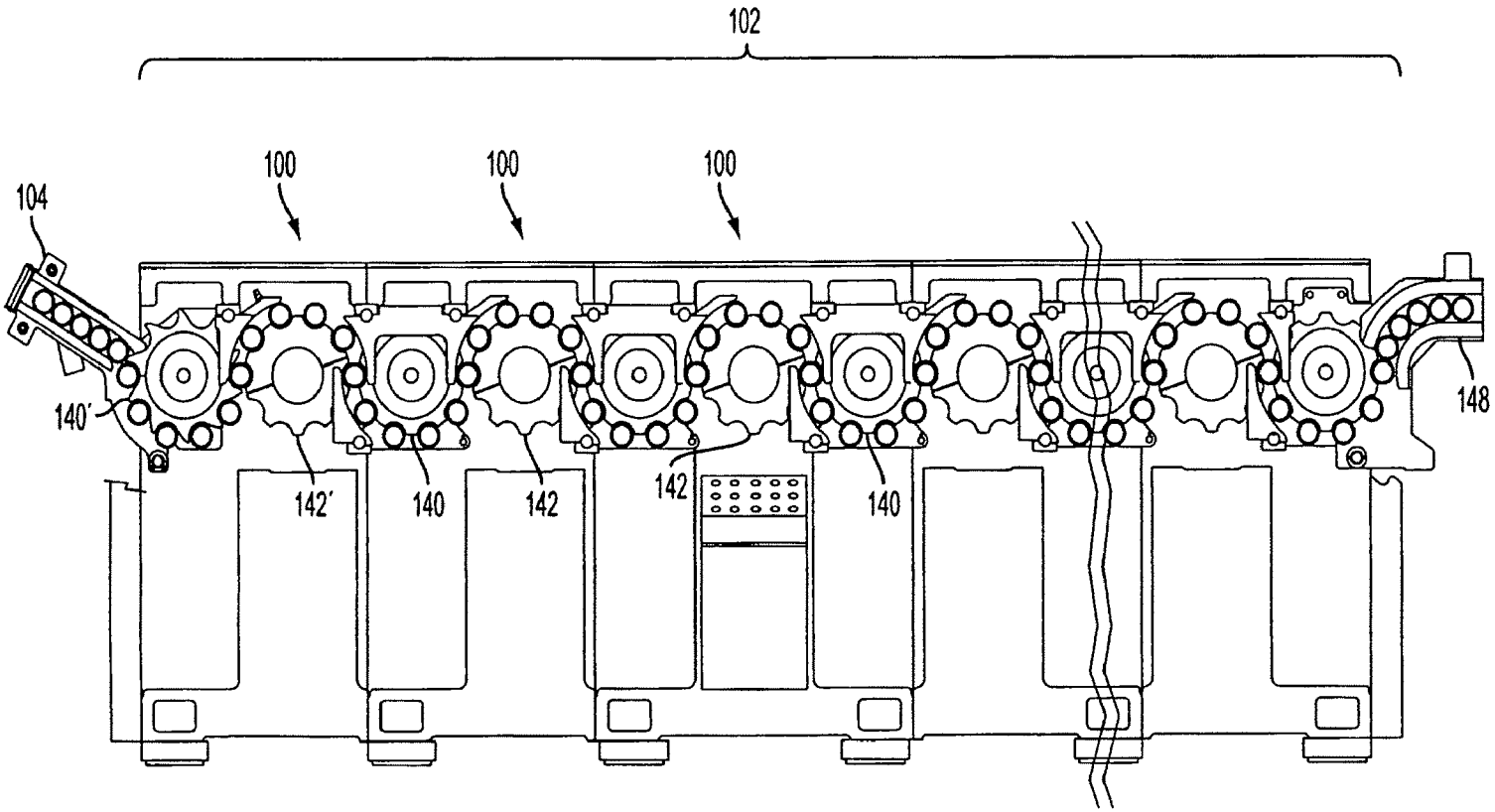
FIG. 1 is a schematic front view of an example of a series of a necking machines in which embodiments of the invention find application.

FIG. 1 shows in schematic elevation, the basic path followed by the cans as they are necked as they pass through a series of turret necking machines which comprise which shall be referred to as a "machine line 102" and in which the various embodiments of the invention are incorporated. In this embodiment, the path is essentially serpentine in configuration.

As shown, the cans enter the line via a can infeed 104 and are picked up by a first transfer starwheel 140'. The cans which are held in position on this first transfer starwheel 140' using a pneumatic pressure differential or "suction" as it will be referred to. Further disclosure of this first starwheel will given hereinlater.

Figure 2:
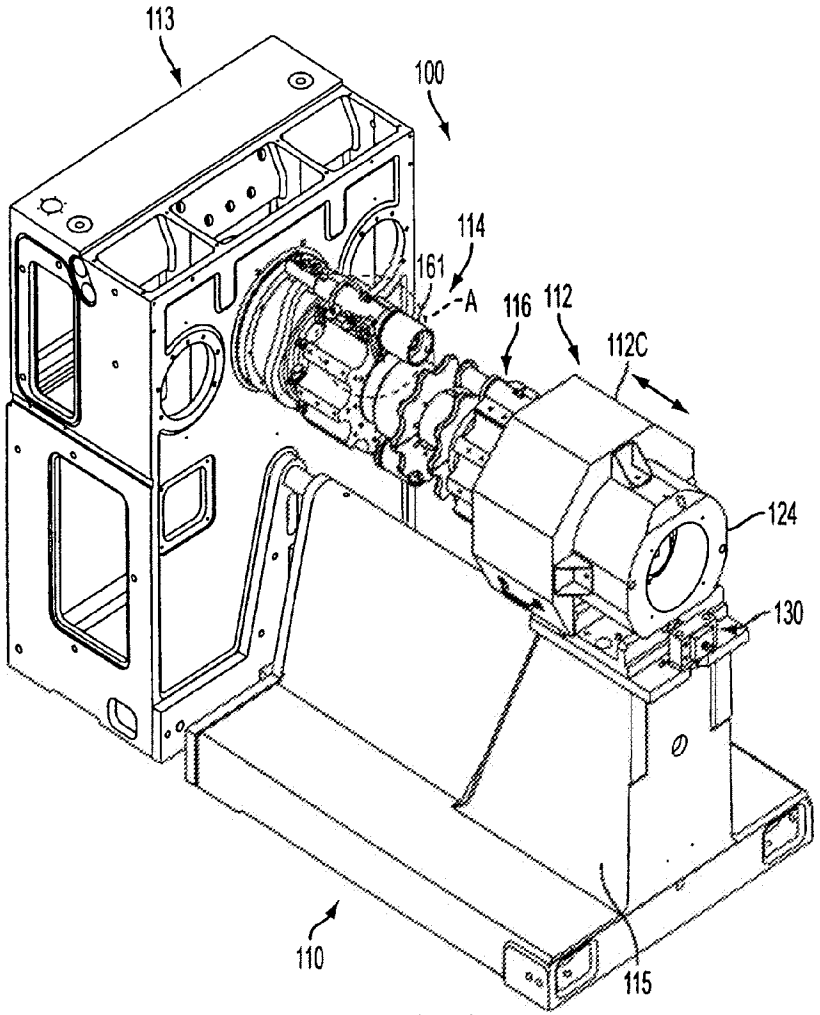
FIG. 2 is a perspective view of a turret module wherein one of the turrets is repositionable with respect to the other in accordance with an embodiment of the invention.

The cans are then passed from the first transfer starwheel to a first turret starwheel 142' and enter into the first stage of necking on the first necking machine 100. While the invention is not so limited, embodiments of the invention are such that necking machines 100 are constructed as modules 110. An example of such a module is shown in FIG. 2. The use of necking machine modules 110 of nature shown in FIG. 2, allows for the machine line 102 to be assembled/changed to provide as many necking stages as is required and to allow for the addition of additional stages such as flanging and/or base reforming/reprofiling which are carried out following the basic necking operations, to be added/removed as desired.

It should be noted that FIG. 2 shows openings through which transfer starwheel drive shafts (described in more detail hereinlater in connection with FIGS. 16-18) are arranged to extend and that a cover 112C is disposed over a portion of the outboard or movable turret 112.

In accordance with a first embodiment of the invention, the outboard turret 112 (or movable turret as it will be referred to) is located distal from the end housing 113, and is supported on the base frame or chassis 115 of the turret module so as to be axially movable toward and away from the inboard turret 114. This allows the movable turret 112 to be repositioned with respect to the other (viz., the inboard or fixed turret 114) and for the distance between the two turrets 112, 114 to be adjusted and thus allow for a change in the length of the cans to be necked. This movement eliminates, merely by way of example, the need to modify/replace the push plates that would otherwise be necessary in order to allow for the difference in can length.

Figure 3:
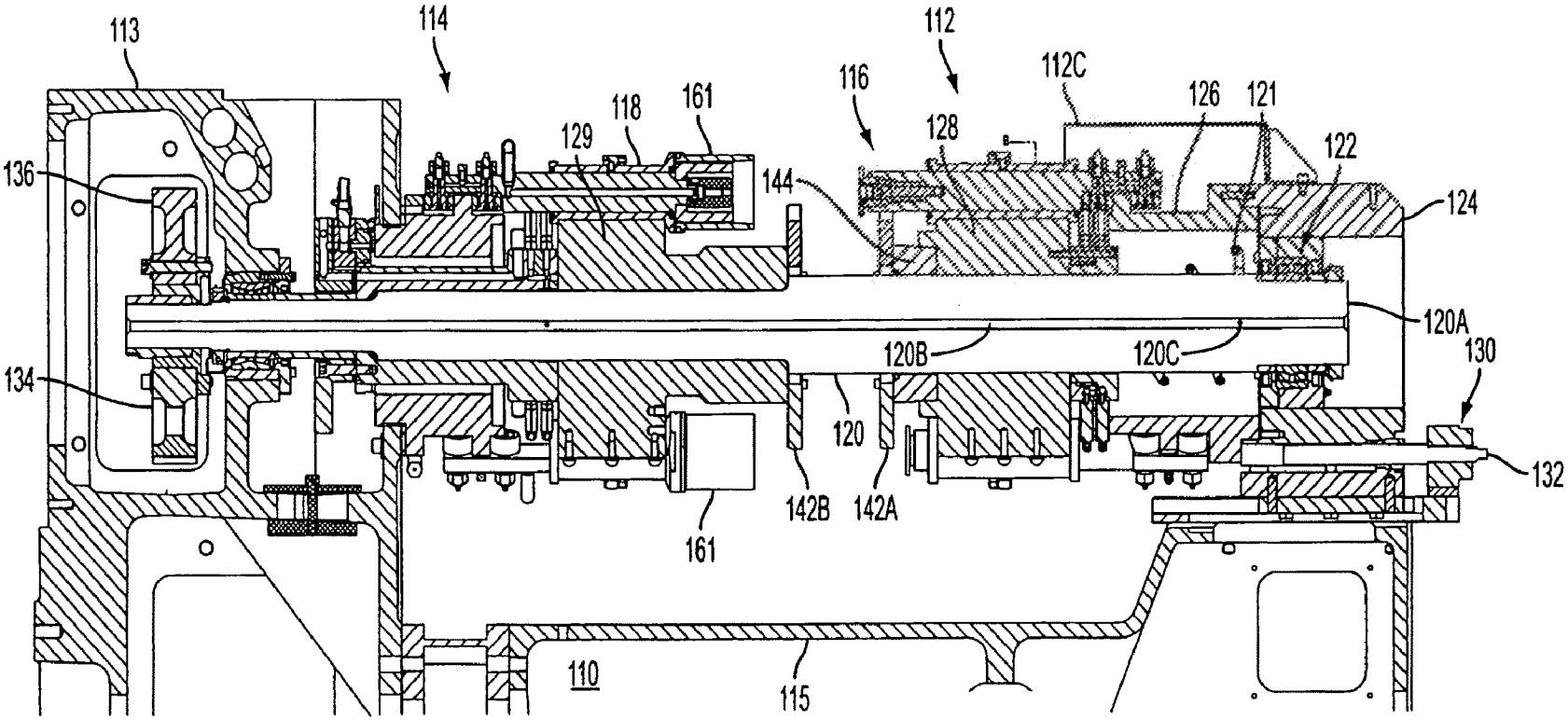
FIG. 3 is a side sectional view of an embodiment of the invention wherein the repositionable turret carries the push plate and ram arrangements and wherein details of the manner in which the repositionable turret is slidably supported so as to be repositionable on a base frame/chassis of a turret module, are shown.
Figure 4:
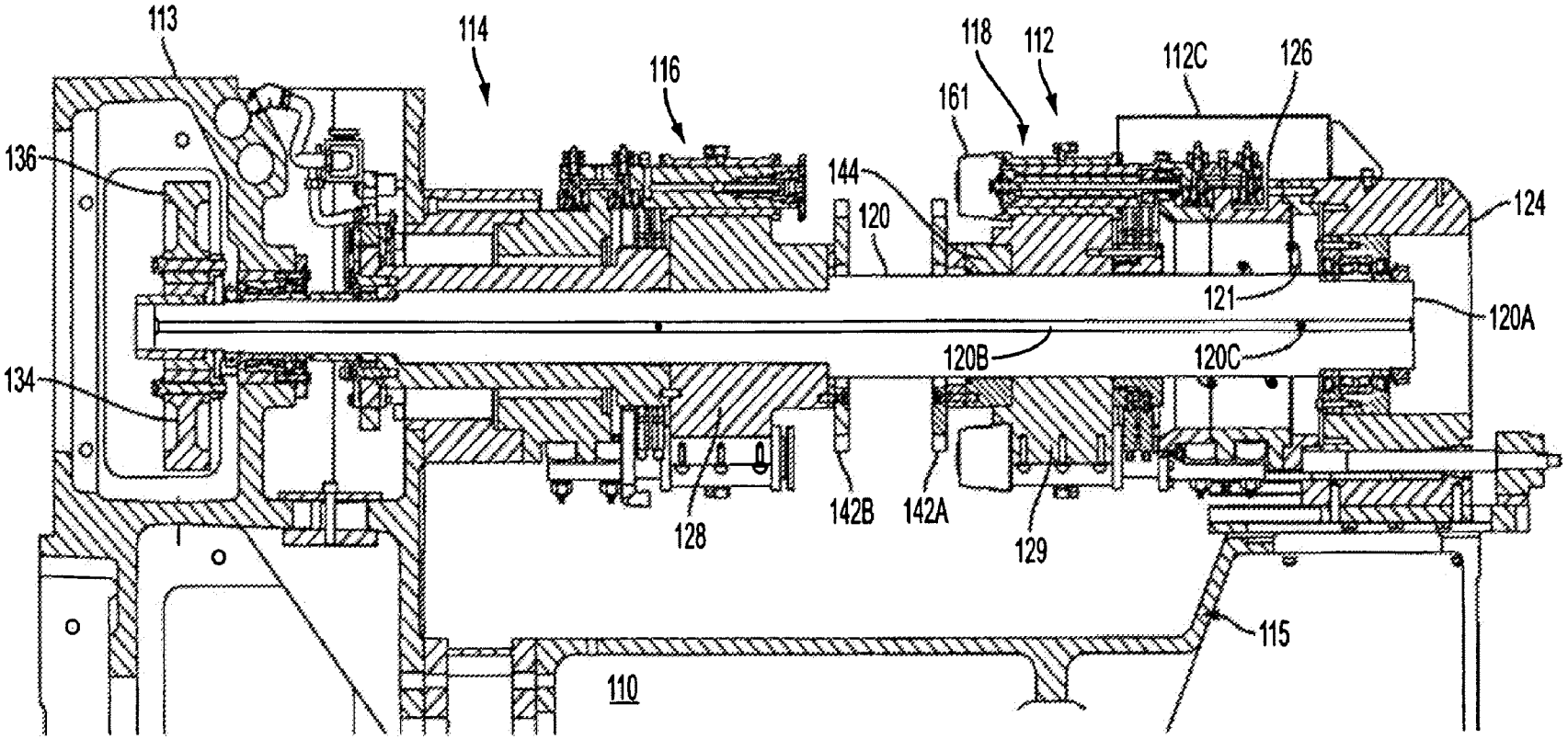
FIG. 4 is a side sectional view similar to that shown in FIG. 3 but wherein an embodiment of the invention is arranged so that the repositionable turret carries the dies and knockout rams or other such process tooling (e.g. reforming, reprofiling tooling etc.) instead of the push plate and ram arrangements, while the non-repositionable turret is arranged to support the push plate and ram arrangements.

In accordance with the embodiments of the invention, the push plate and ram arrangements 116 can be supported on either the movable turret 112 or the fixed turret 114 and that the corresponding necking dies and knockout ram arrangements 118 can be supported on the other of the turrets. For example, FIG. 3 shows the arrangements wherein the push plate and ram arrangements 116 are supported on the movable turret 112, while FIG. 4 shows an embodiment wherein they are mounted on the stationary turret 114.

The necking machine embodiments, irrespective of the above mention disposition of the push plate and ram arrangements, are such that a drive shaft 120 extends through both of the turrets 112, 114. The "outboard" end 120A of this "turret" drive shaft 120 is supported by way of a bearing 122 supported in a cam support member of the outboard turret 112. Since this turret 112 is required to be axially movable and the drive shaft 120 axially immovable, the bearing 122 is arranged to either slide within the cam support 124 or the bearing 122 is stationarily supported in the cam support 124 and the drive shaft 120 is adapted to slide through the bearing 122 in a manner which allows the movable turret to be moved within its travel limits. In the illustrated embodiments, the former arrangement is used.

A cam 126 is supported on the inboard face of the cam support 124. As shown, both the cam 126 and cam support 124 are, in the illustrated embodiments, basically hollow and remain stationary during necking operations. In FIG. 3, a ram block 128 is splined to the drive shaft 120 for synchronous rotation therewith, and arranged to seat on the inboard face of the cam 126. This ram block 128 supports the push plate and ram arrangements 116 in a manner wherein the push plate and ram arrangements are operatively connected with the cam 126. Rotation of the ram block 128 with respect to the cam induces operatively reciprocation of the push plate and ram arrangements 116 as the rotate with the ram block 128.

Inasmuch as the ram block 128 is movable with respect to the chassis, in order to supply lubricant the push plate and ram arrangements 116, the drive shaft 120 is formed with a coaxial bore 120B and a radial passage terminating in port 120C. A helical tube 121 which is disposed about the drive shaft 120 in the manner illustrated in FIG. 3, is connected to the port 120C at one end and suitably connected (albeit indirectly) with the push plate and ram arrangement 116 at the other end.

In the embodiment shown in FIG. 4, the ram block 128 is replaced with a tooling block 129 and the ram block 128 is disposed with the stationary or fixed turret with respect to FIG. 3. In this arrangement, the process ram arrangement 118 are reciprocated in place of the push plate and ram arrangements 116. A similar helical lubricating tube arrangement is provided to supply lubricant to the process ram arrangements 118.

The cam support 124 (shown in FIGS. 6-15) is operatively interconnected with the frame or chassis 115 through a table 124B (which forms part of the cam support 124 and which is fixed to the chassis 115) and drive mechanism 130 which allows the cam support 124 to be moved along the table toward and away from the fixed or stationary turret 114. This drive mechanism 130 comprises a rotatable threaded shaft 132 which is geared in a manner wherein rotation of the shaft 132 moves the cam support 124 with respect to the table 124B and therefore the chassis 115. This arrangement is similar to the gearing/feed arrangements which are found on lathes and other types of cutting machinery. Accordingly, since this type of positional translation arrangement is known, a detailed description of the same will be omitted for brevity.

When moving the cam support 124 along the chassis 115, the cam 126 and the block (either the ram block—FIG. 3 or the process block—FIG. 4) that is disposed with the cam, must be prevented from undergoing relative axial displacement and separation in order to prevent the loss of sealing and other operative connections important to the operation of the apparatus carried on the support block (as it will be generically referred to).

Figure 31:
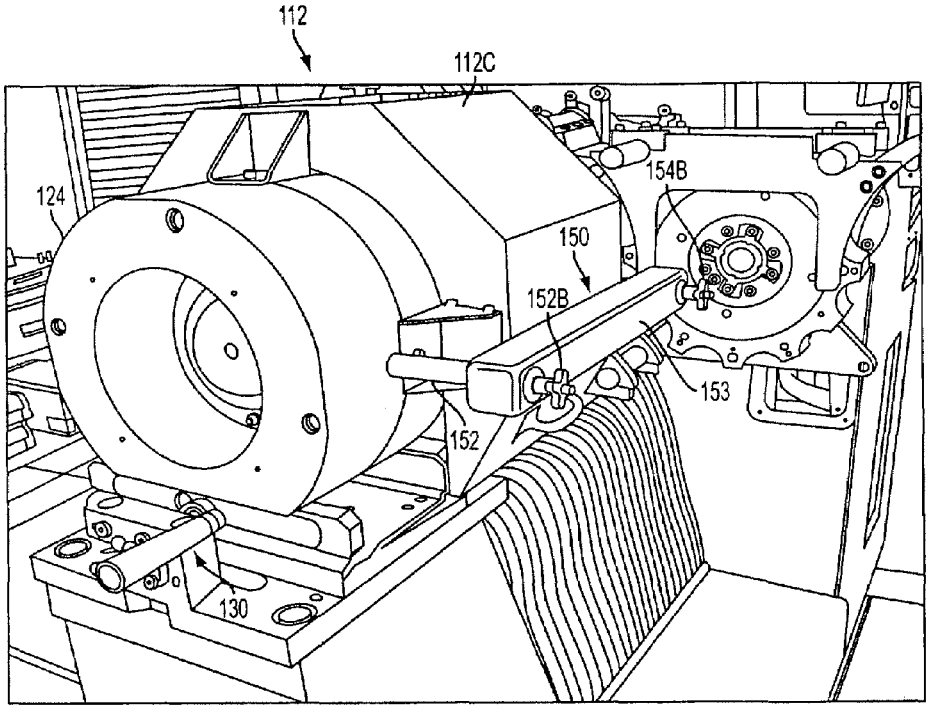
FIG. 31 is a perspective view showing the disposition of an embodiment of an adjusting tool which is installed to facilitate repositioning of the repositionable turret.
Figure 32:
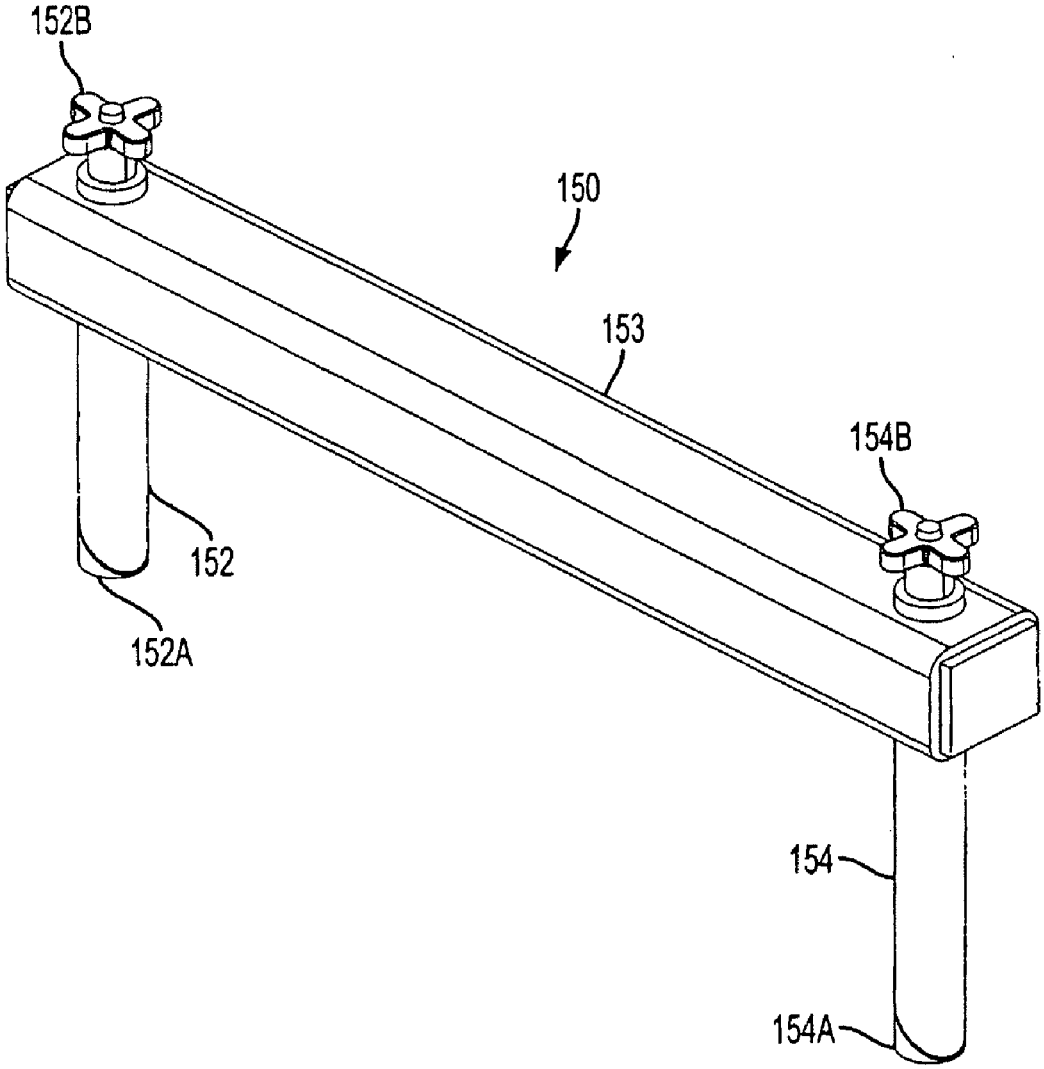
FIG. 32 is a perspective view of an adjusting tool shown in FIG. 31.

In order to achieve this, a shaft adjusting tool 150 of the nature shown in FIG. 32 is disposed in the manner depicted in FIG. 31. In more detail, this shaft adjusting tool 150 has one engagement member 152 which is receivable in a bore formed in the side of the cam support 124 and a second engagement member 154 receivable in a bore formed in the support block (128, 129) which is associated with the cam 126. A rigid bridge 153 interconnects and rigidly supports the two engagement members 152, 154.

By suitably rotating the support block (128, 129), it is possible to bring this bore into position wherein the first and second engagement members can be inserted into the respective bores. In the illustrated embodiment, the shaft tool 150 is provided with locking elements 152A, 154A which respond to rotation of the knobs 152B, 154B in manner which temporarily locks the ends of the engagement members in their respective bores.

With the shaft tool disposed in and locked place in the manner illustrated in FIG. 31, a locking mechanism which locks the cam support 124 in position on the chassis 115 is released along with a securing device which is used to secure the support block (either 128, 129) against axial movement along the turret drive shaft 120. This conditions the unit comprising the cam support 124, the cam 126 and the support block (one of 128, 129), to be movable as a single unit with respect to the chassis 115.

A tool or spacer (not shown) interposed between a selected push plate and the corresponding die, can be used to gauge when the movable turret 112 (in this case the cam support 124, the cam 126 and the support block 128/129), has been moved to an appropriate position with respect to the fixed turret 114, for necking the next can size. When the movable turret 112 is suitably positioned for the new can size, the cam support 124 is locked in position on the chassis 115. The shaft tool 150 is then released and removed and lastly the support block (128/129) is secured to the turret drive shaft 120 to prevent axial displacement during operation.

Figure 15:
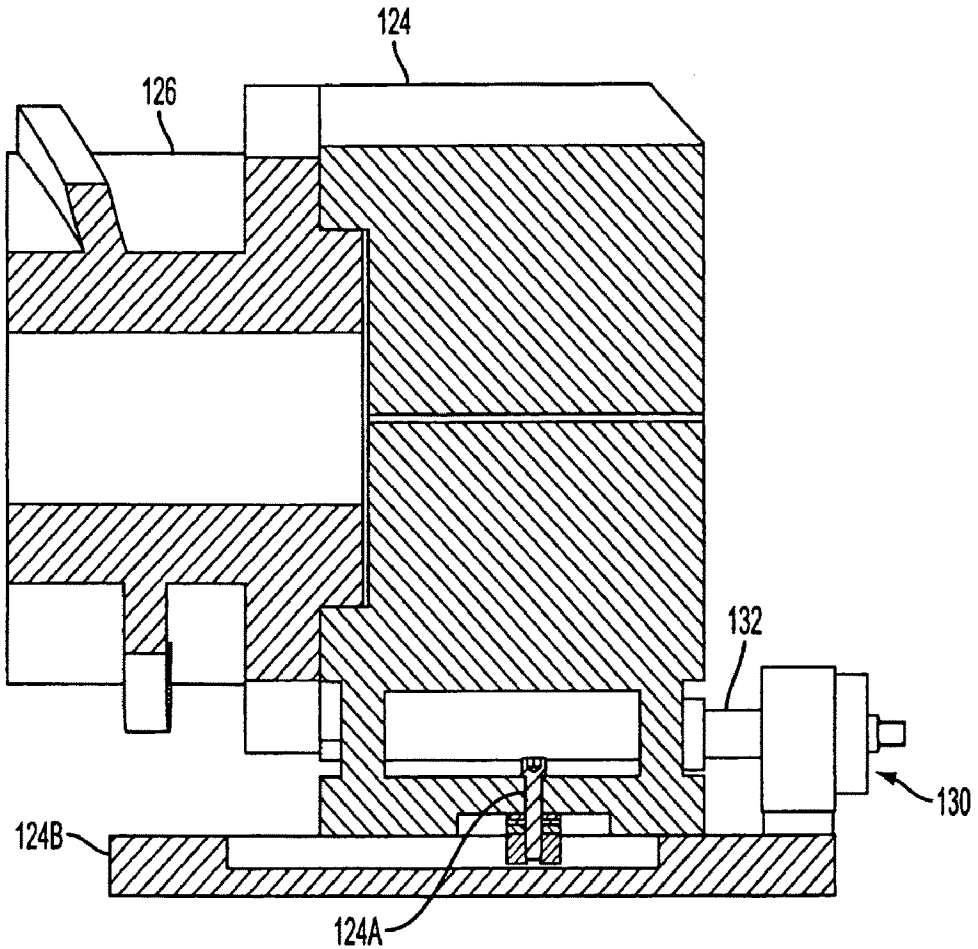

FIG. 15 shows an example of an locking arrangement 124A which can be tightened to induce a relative movement preventing interlock between the table 124B, which, as noted above, is configured to be immovably secured to the chassis 115 and a portion 124C of the cam support 124 which is slidably supported in guide tracks formed in the table 124B and movable along the table 124B in response to the rotation of the shaft 132. The tracks are, of course, configured to allow only axial movement (viz., movement essentially parallel to the axis of the turret drive shaft 120) and can be of the type found on lathes and the like.

Merely by way of example, the locking arrangement can take the form of an expansion device which responds to the rotation of a bolt forming part thereof, and snugly engages a part of the track formed in the table 124B. However, the embodiments are not limited to this particular arrangement and any suitable releasable clamp can be used to securely lock the main body of the cam support 124 and the table 124B together.

Figure 16:
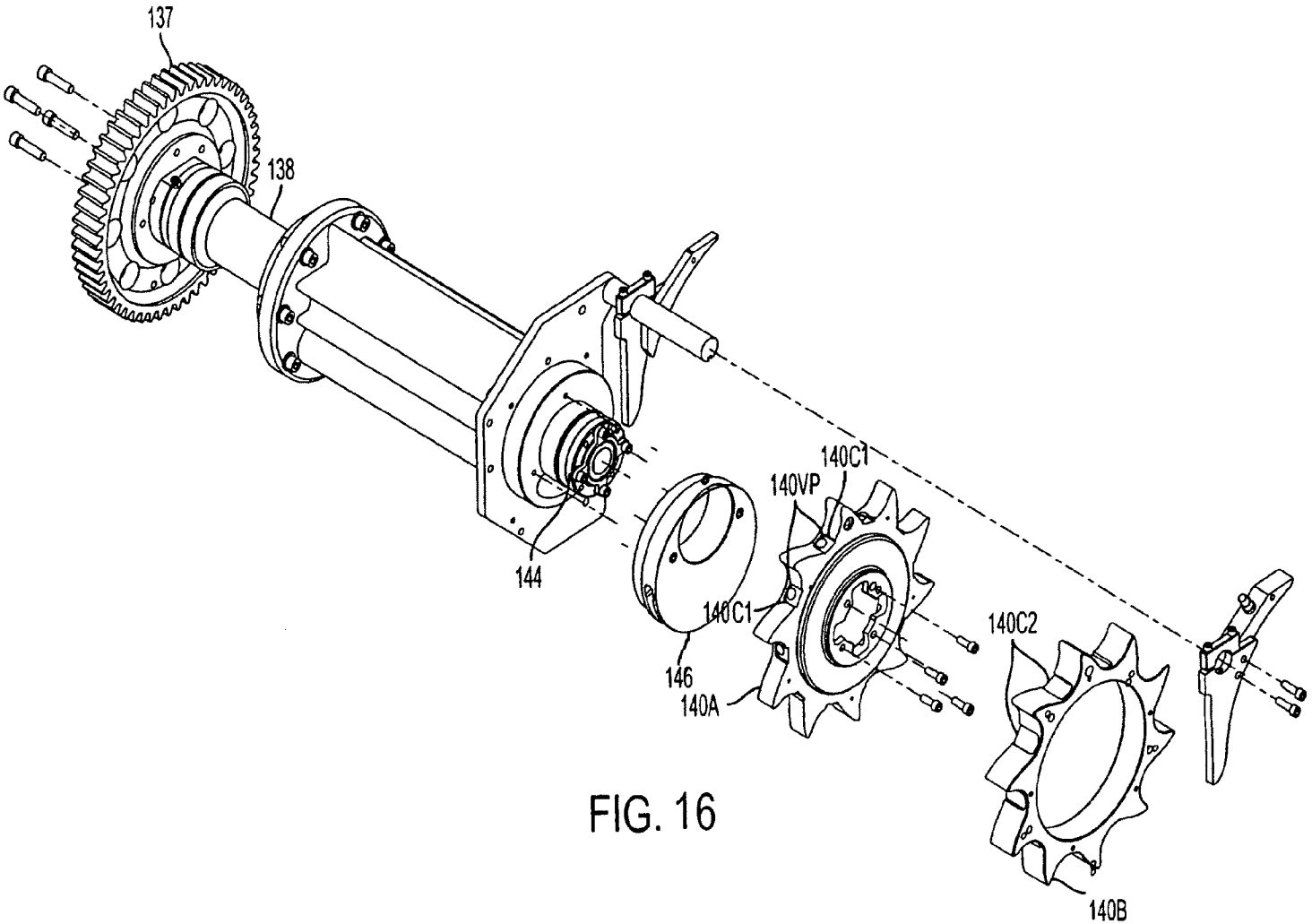
FIG. 16 is an exploded perspective view showing the configuration and arrangement of an embodiment of a transfer starwheel which is located at the head of the machine line and which receives cans that are supplied from an infeed arrangement.
Figure 17:
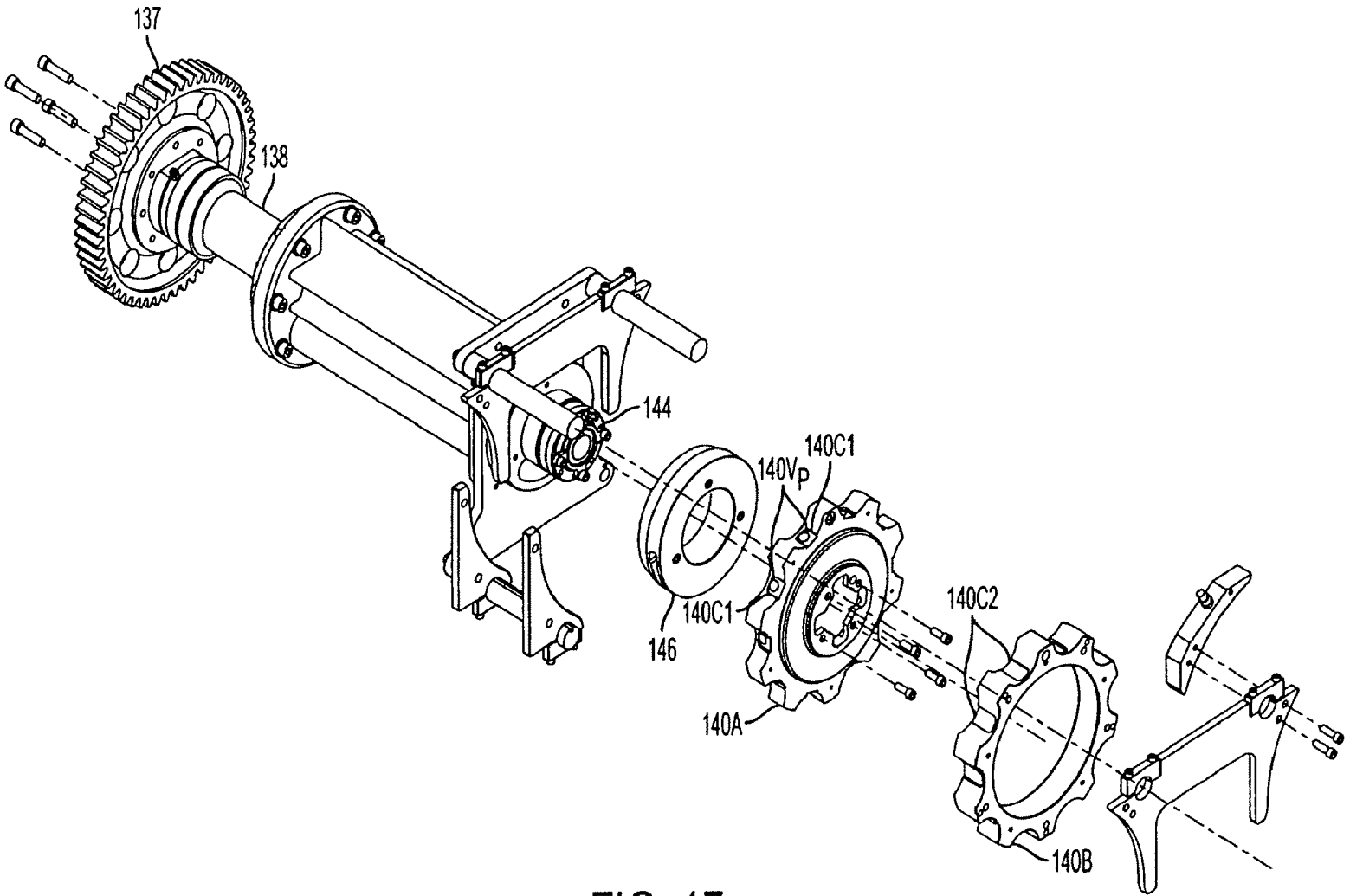
FIG. 17 is an exploded perspective view showing the configuration and arrangement of an embodiment of a transfer starwheel which is used to transfer cans between neck shaping turrets.

A drive mechanism 134 is operatively connected with the end of the turret drive shaft 120. A gear 136 on the end of drive shaft 134 is placed in drive connection with a gear 137 on the end of a transfer drive shaft 138. An example of this type of drive shaft is shown in FIGS. 16 and 17. The transfer drive shaft 138 is arranged to support a transfer starwheel 140 in a position with respect to a turret starwheel 142 such that cans can be transferred there between. An example of this disposition is shown in FIGS. 18-20.

In the machine line 102, there is, in effect, a transfer starwheel disposed on either side each of each turret starwheel 142 in the manner depicted in FIG. 1.

Figure 18:
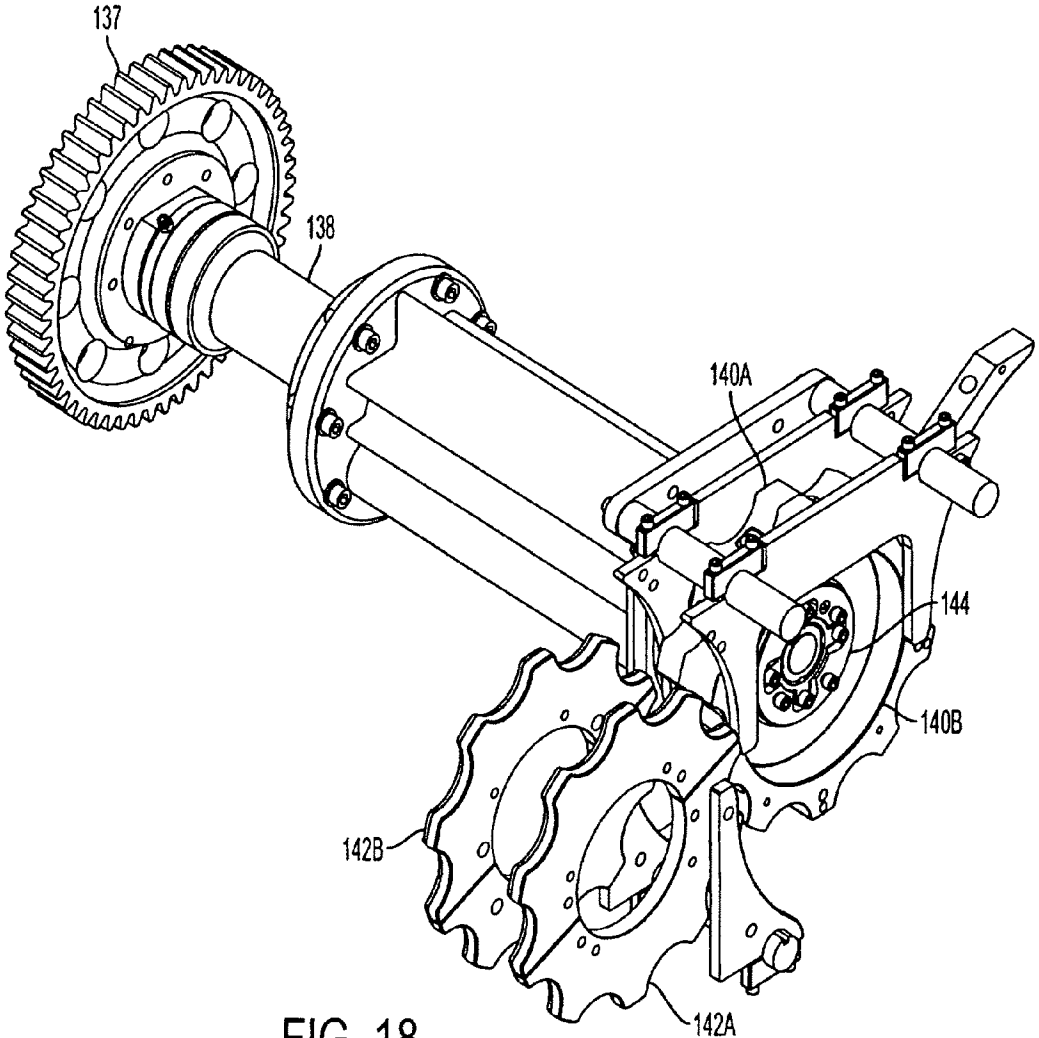
FIG. 18 is a perspective view showing the relationship between the transfer starwheel shown in FIG. 17 and the turret starwheel which is located upstream thereof.
Figure 19:
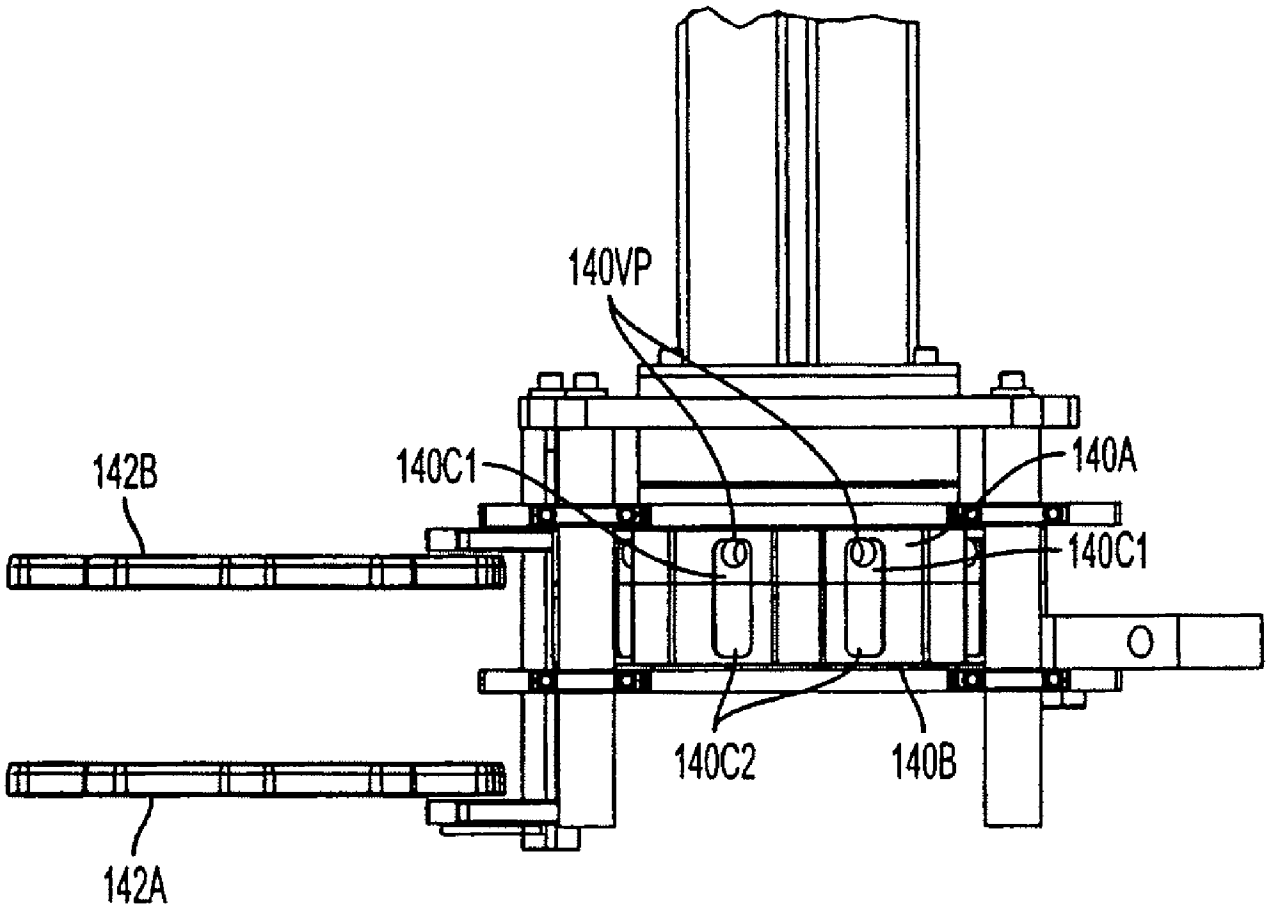
FIGS. 19 and 20 are respectively plan and elevation views of the arrangement depicted in FIG. 18.
Figure 20:
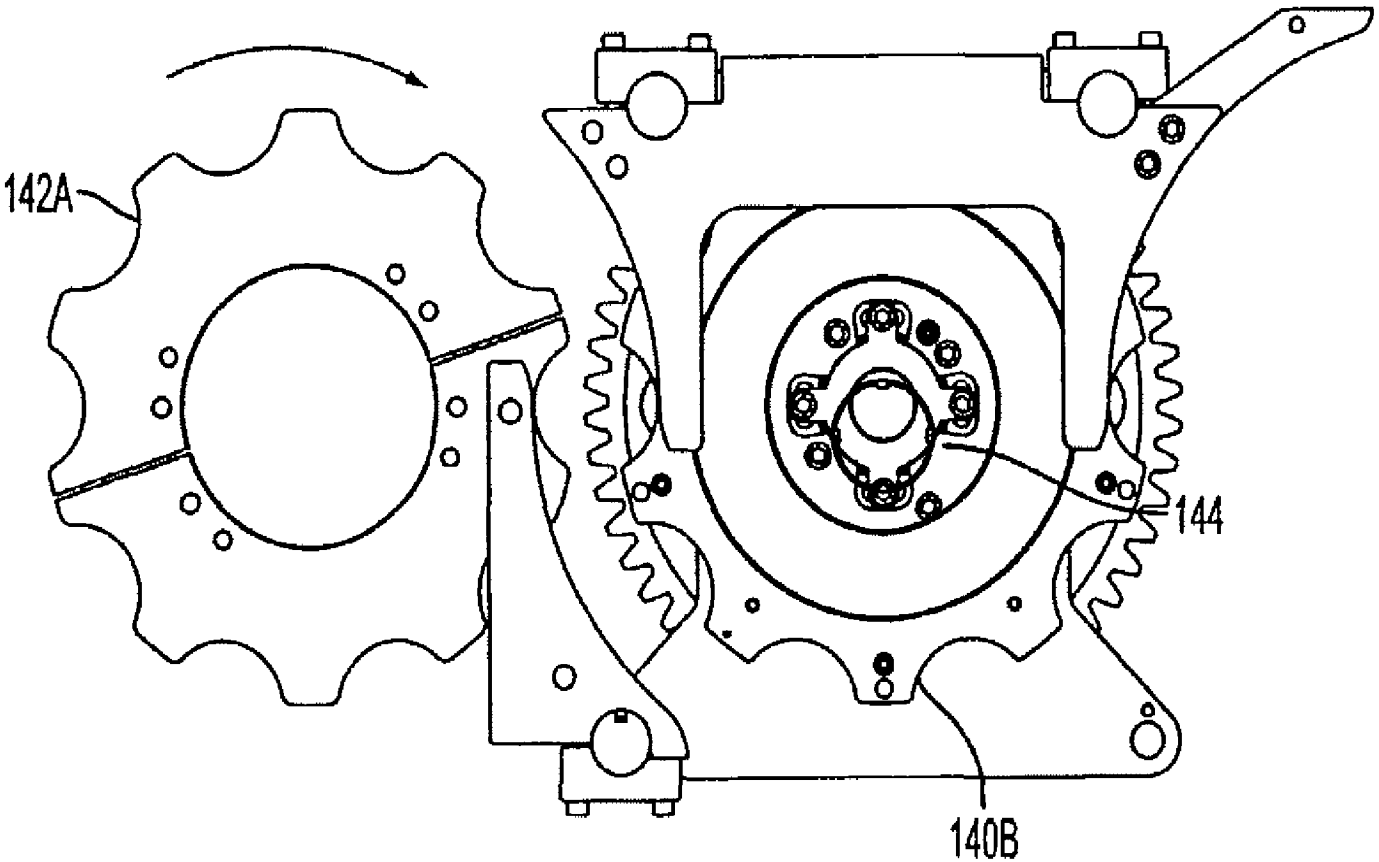
Figure 21:
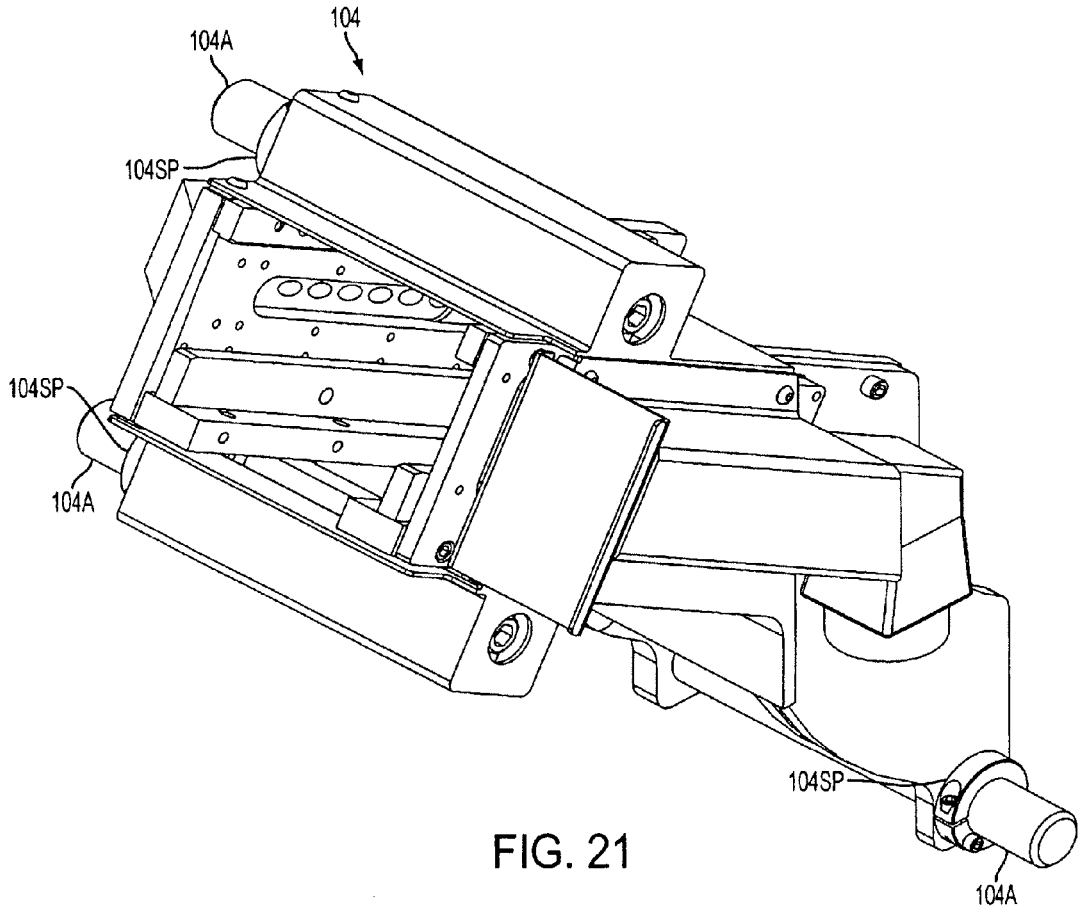
FIGS. 21 and 22 are perspective views of an embodiment of infeed arrangement which is used in accordance with the present invention, and which is shown configured to accept and feed relatively long cans.
Figure 22:
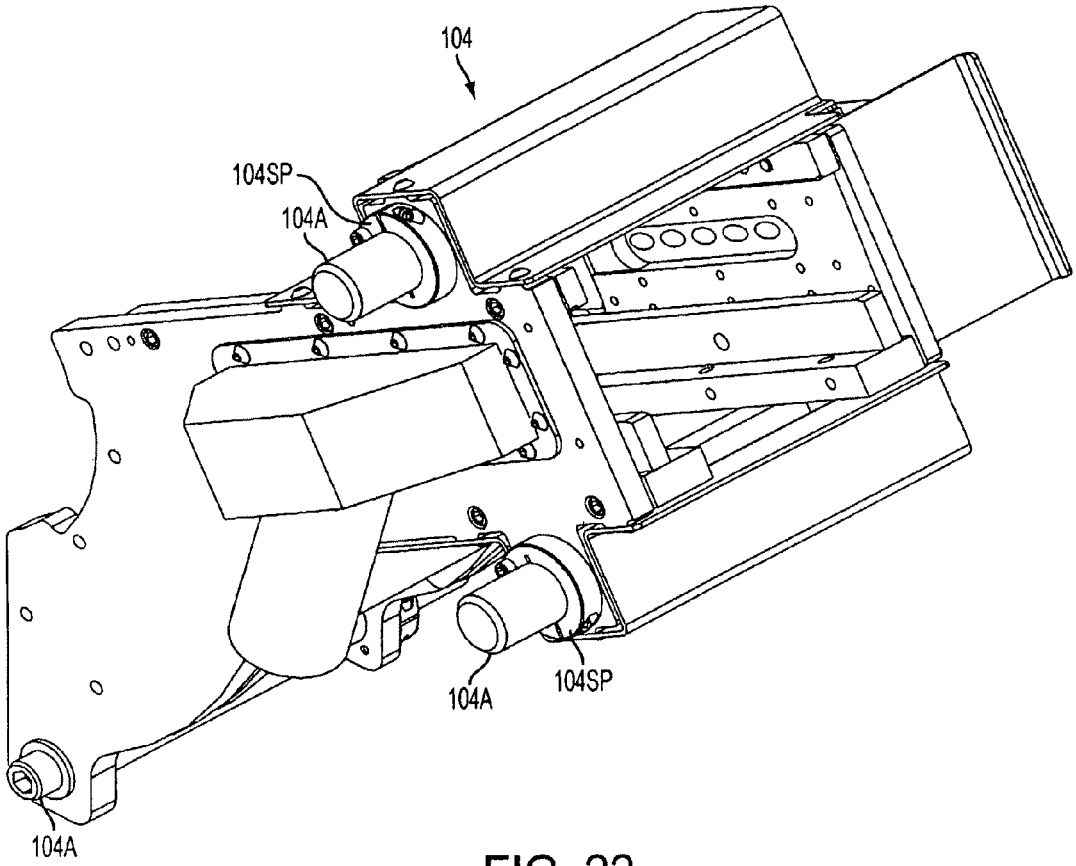
Figure 23:
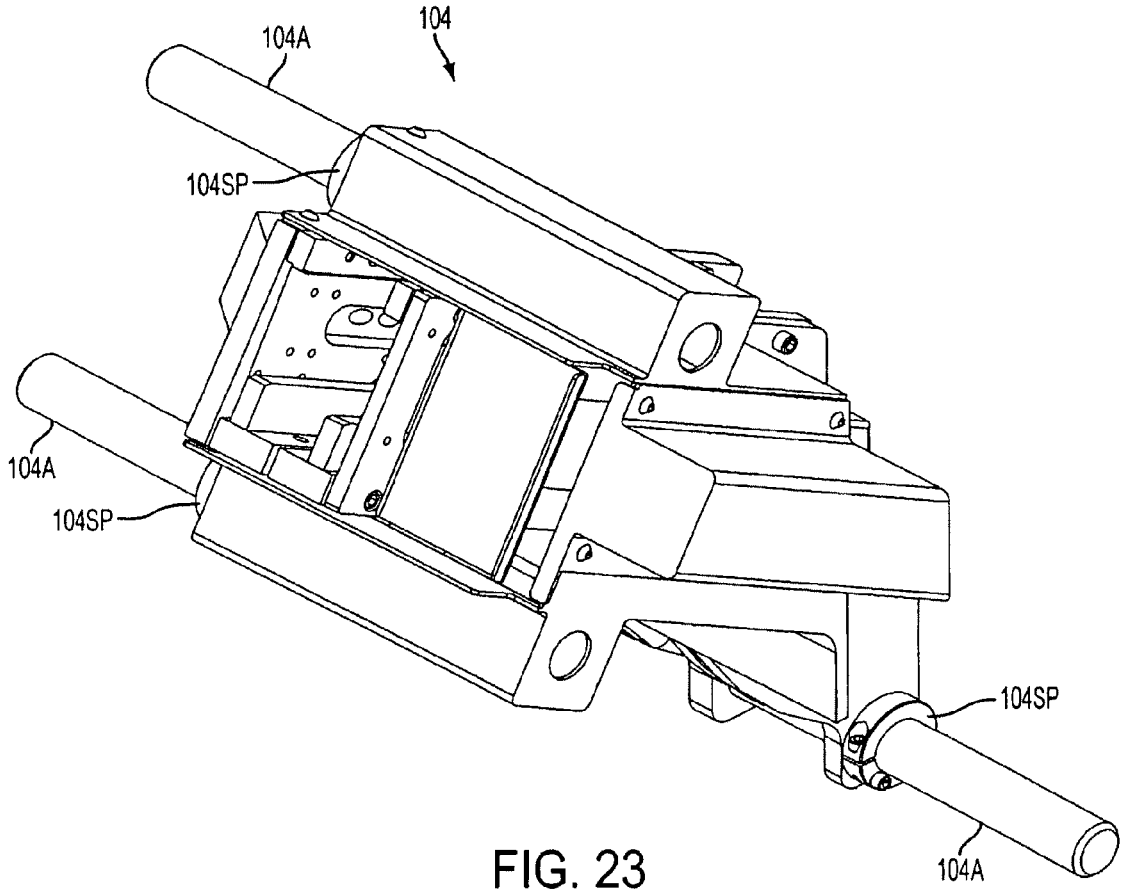
FIGS. 23 and 24 are perspective views of the of infeed arrangement shown in FIGS. 21 and 22 adjusted to receive and feed relatively short cans.
Figure 24:
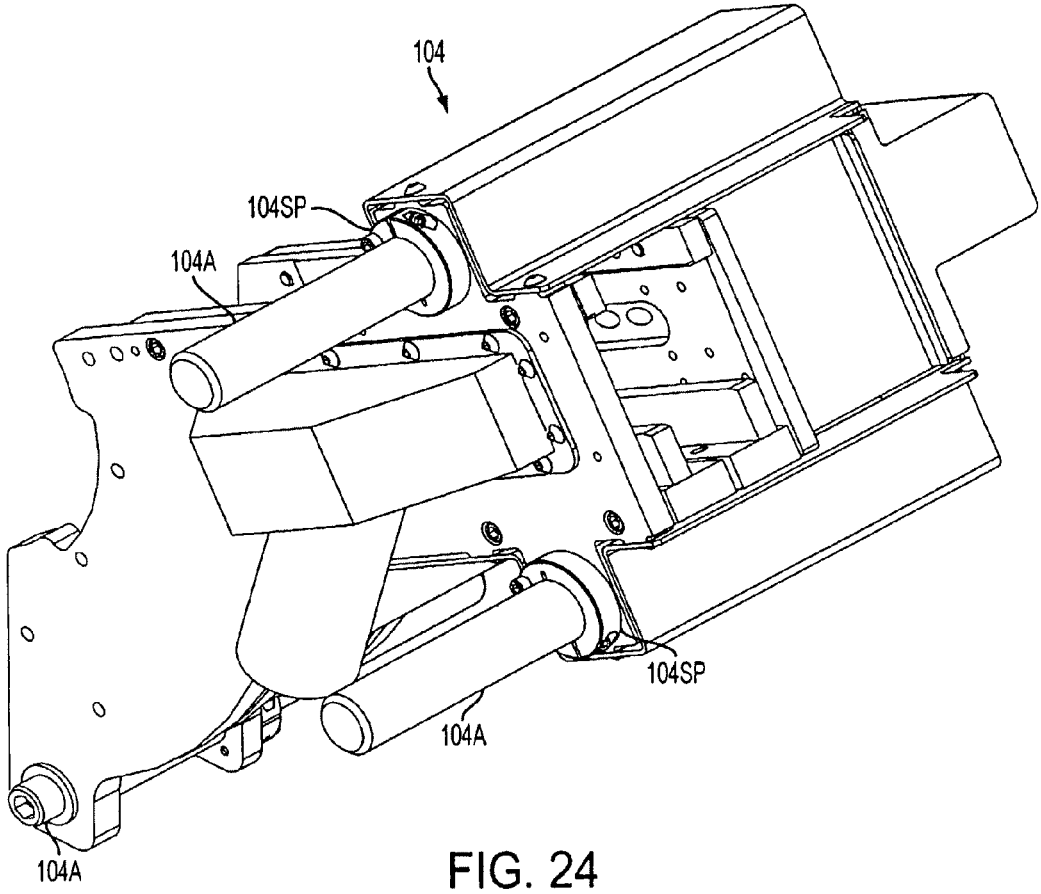
Figure 25:
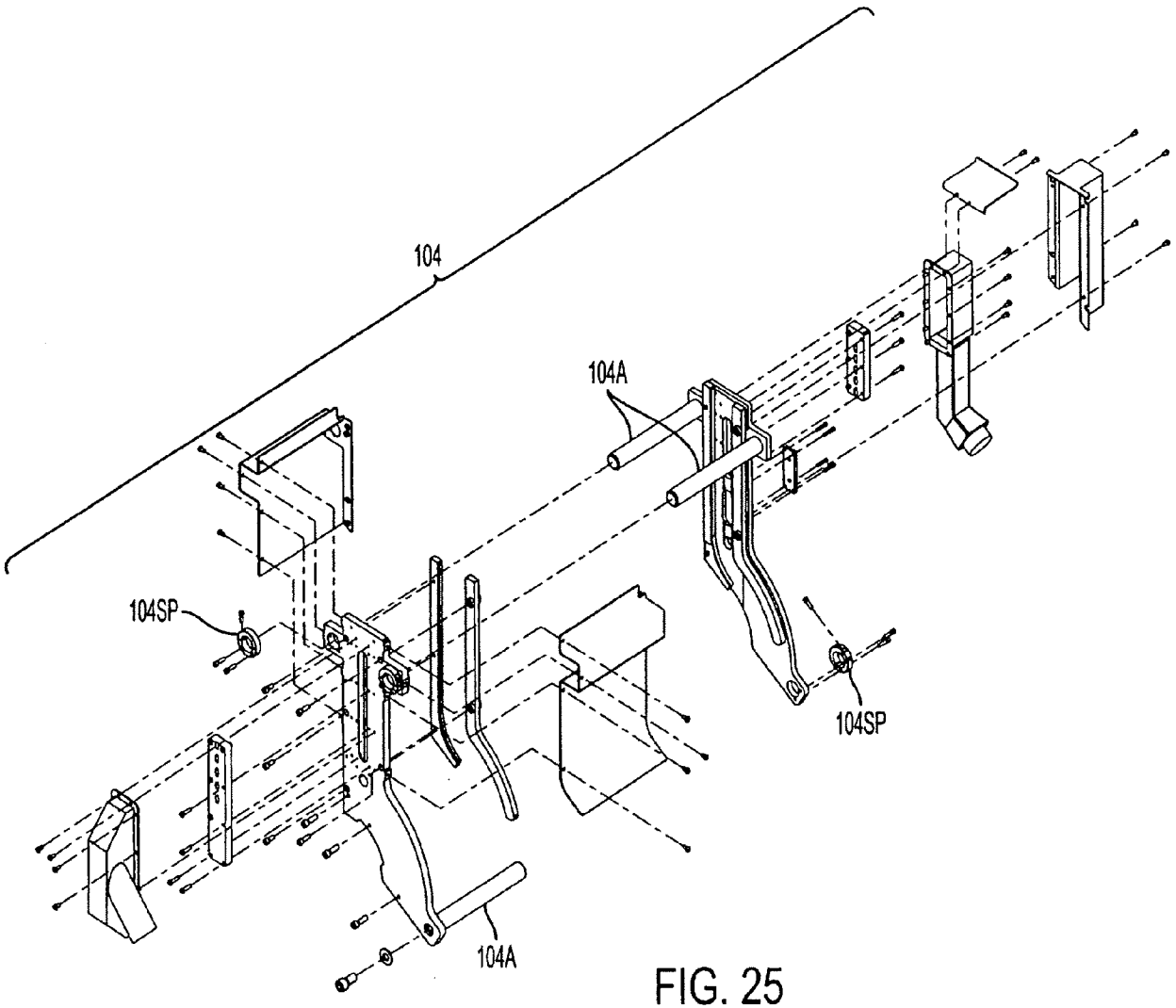
FIG. 25 is an exploded perspective view of the arrangement shown in FIGS. 21-24.
Figure 26:
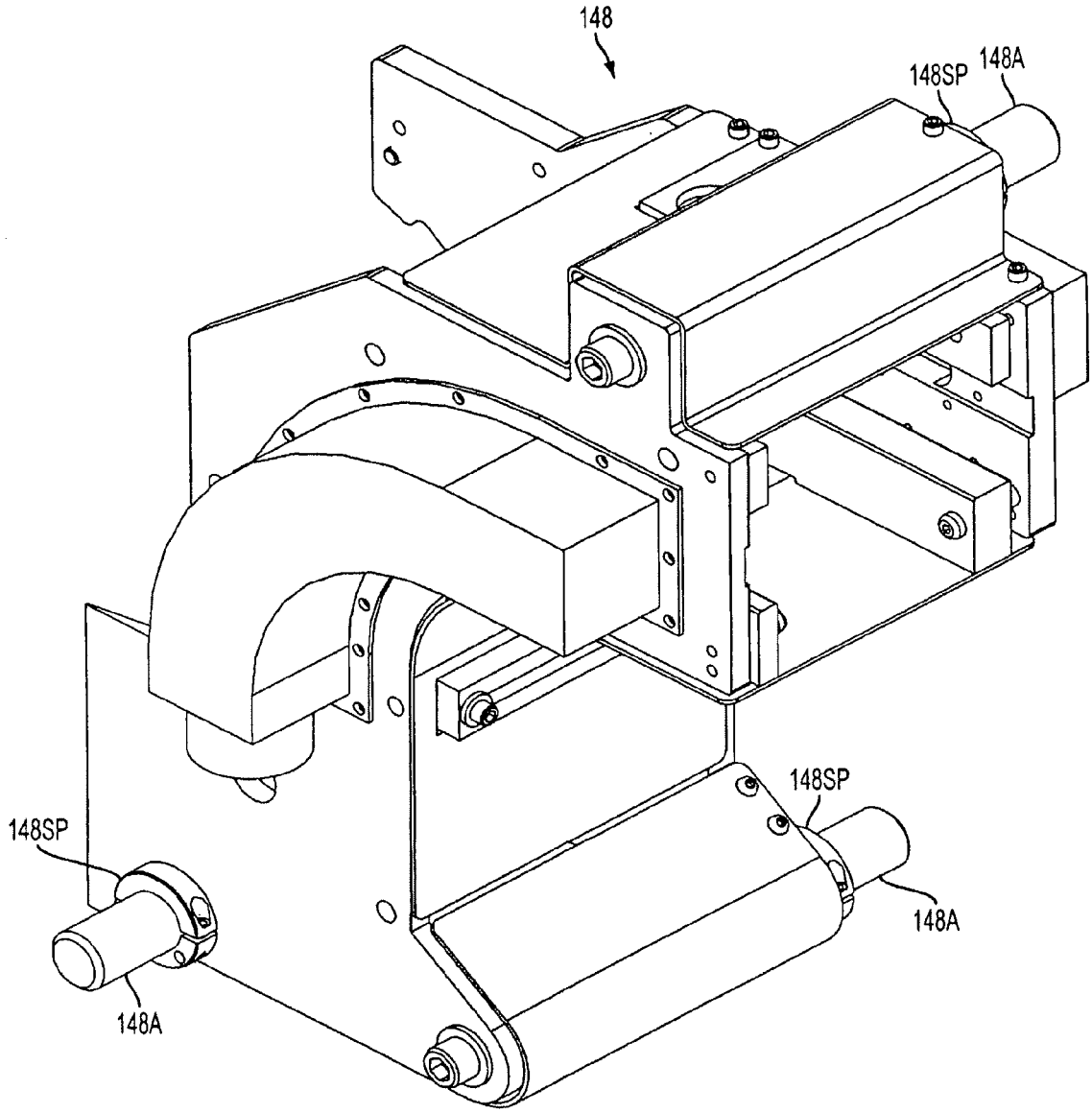
FIGS. 26 and 27 are perspective views of an embodiment of a can discharge arrangement used to receive and discharge cans which have been necked using structure such as that depicted in the above-mentioned drawings.
Figure 27:
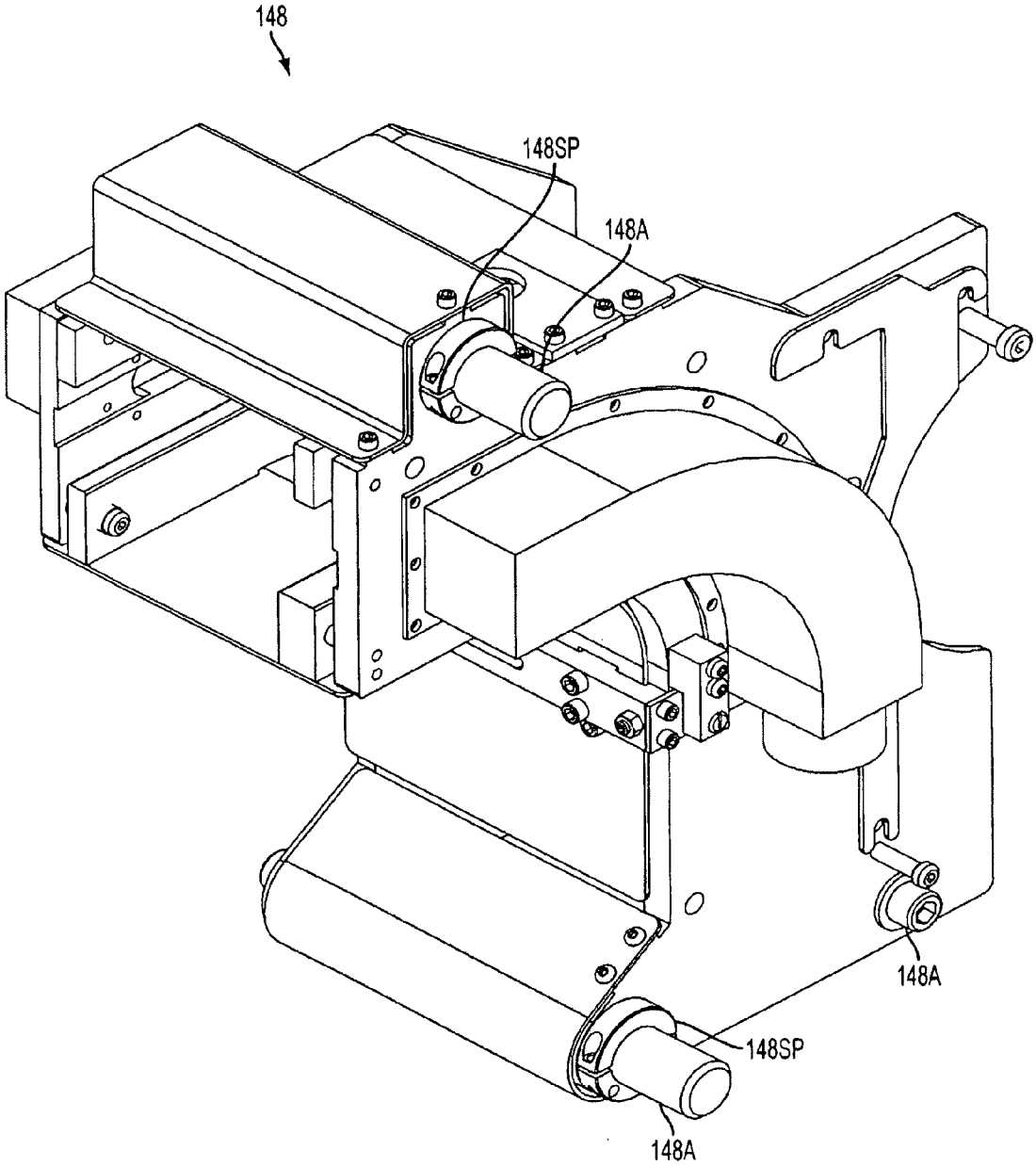
Figure 28:
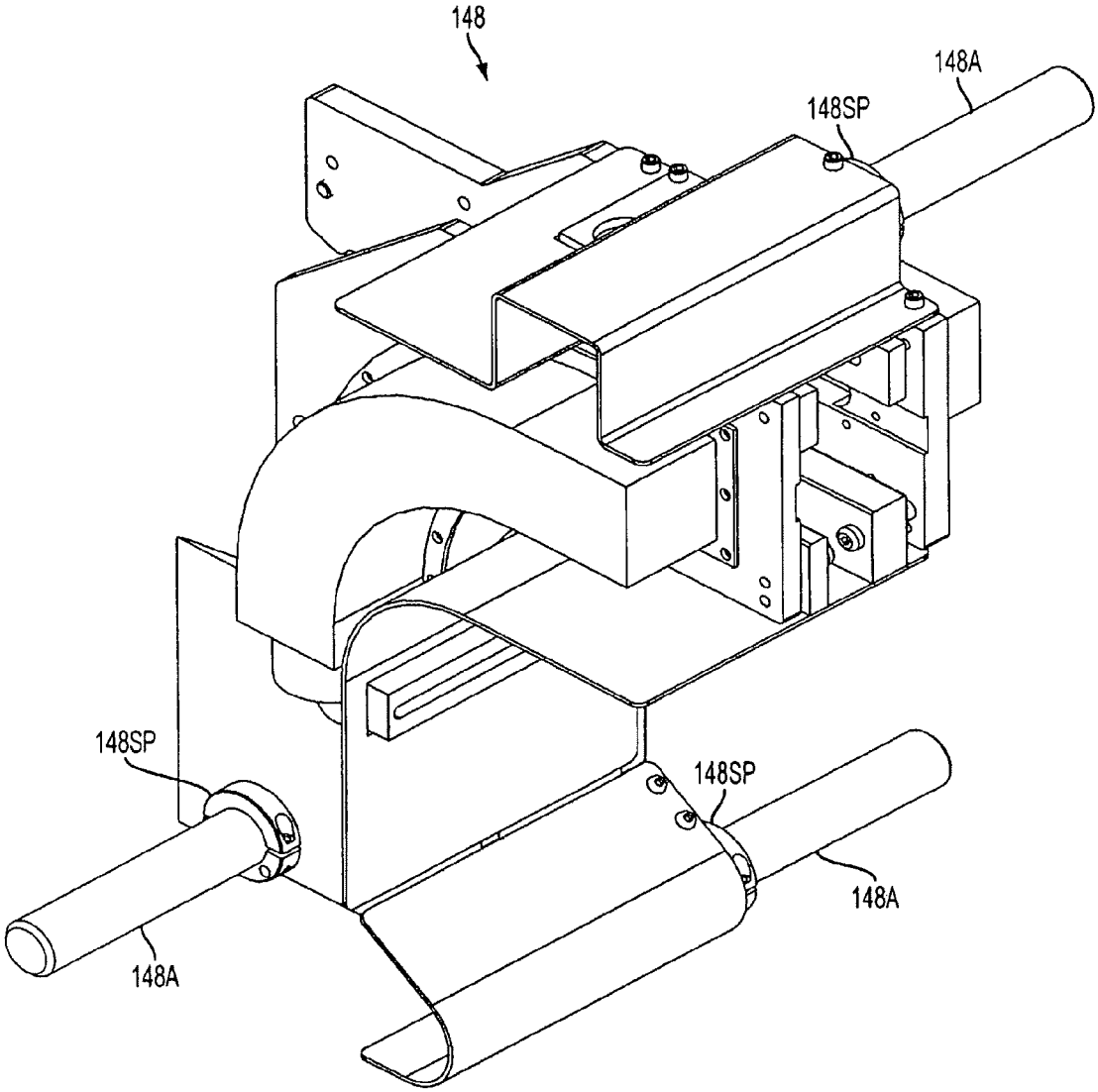
FIGS. 28 and 29 are perspective views of the discharge embodiment shown in FIGS. 26 and 27, which has been configured to handle cans shorter than those for which the arrangement show in FIGS. 26 and 27, is configured.
Figure 29:
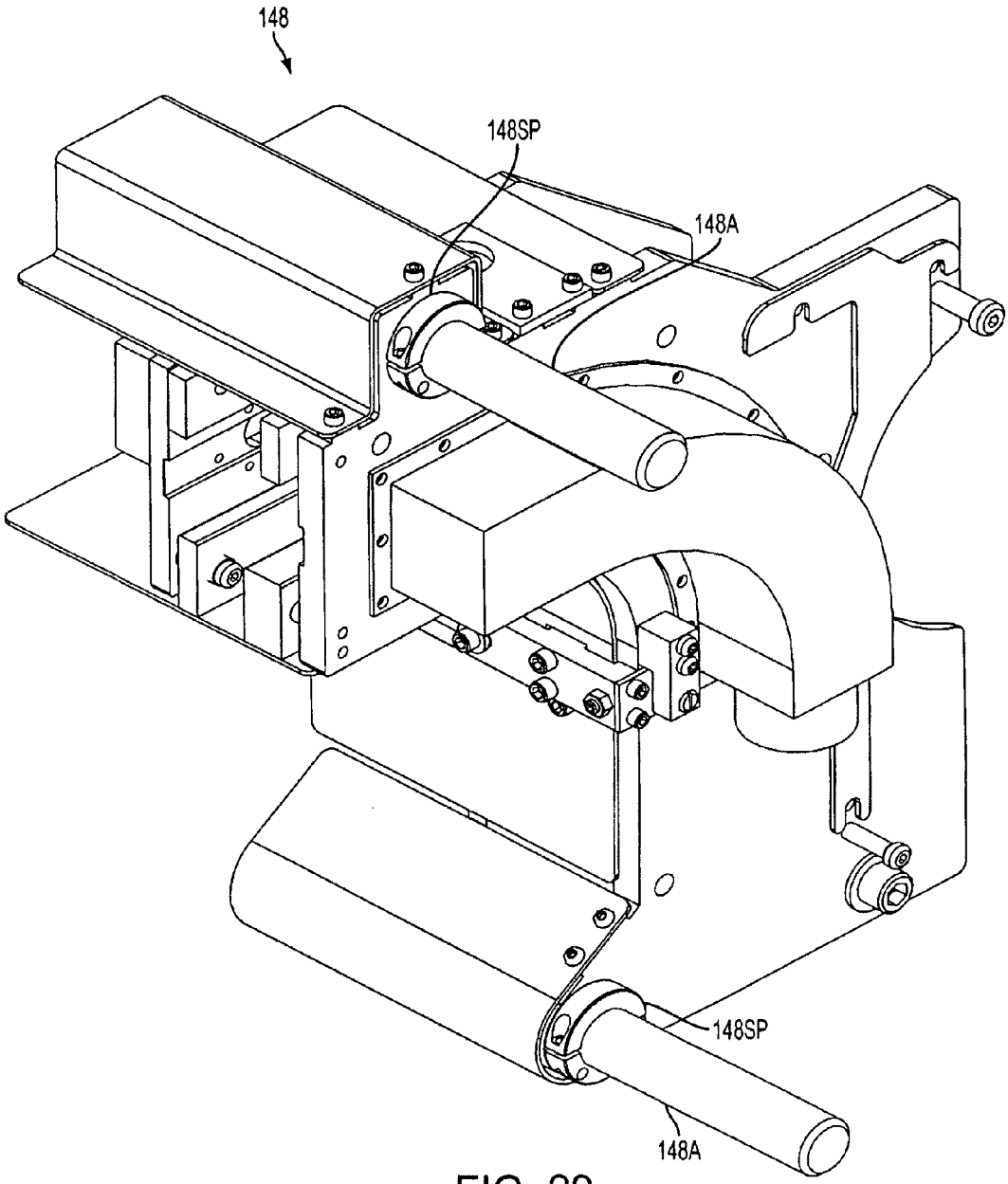
Figure 30:
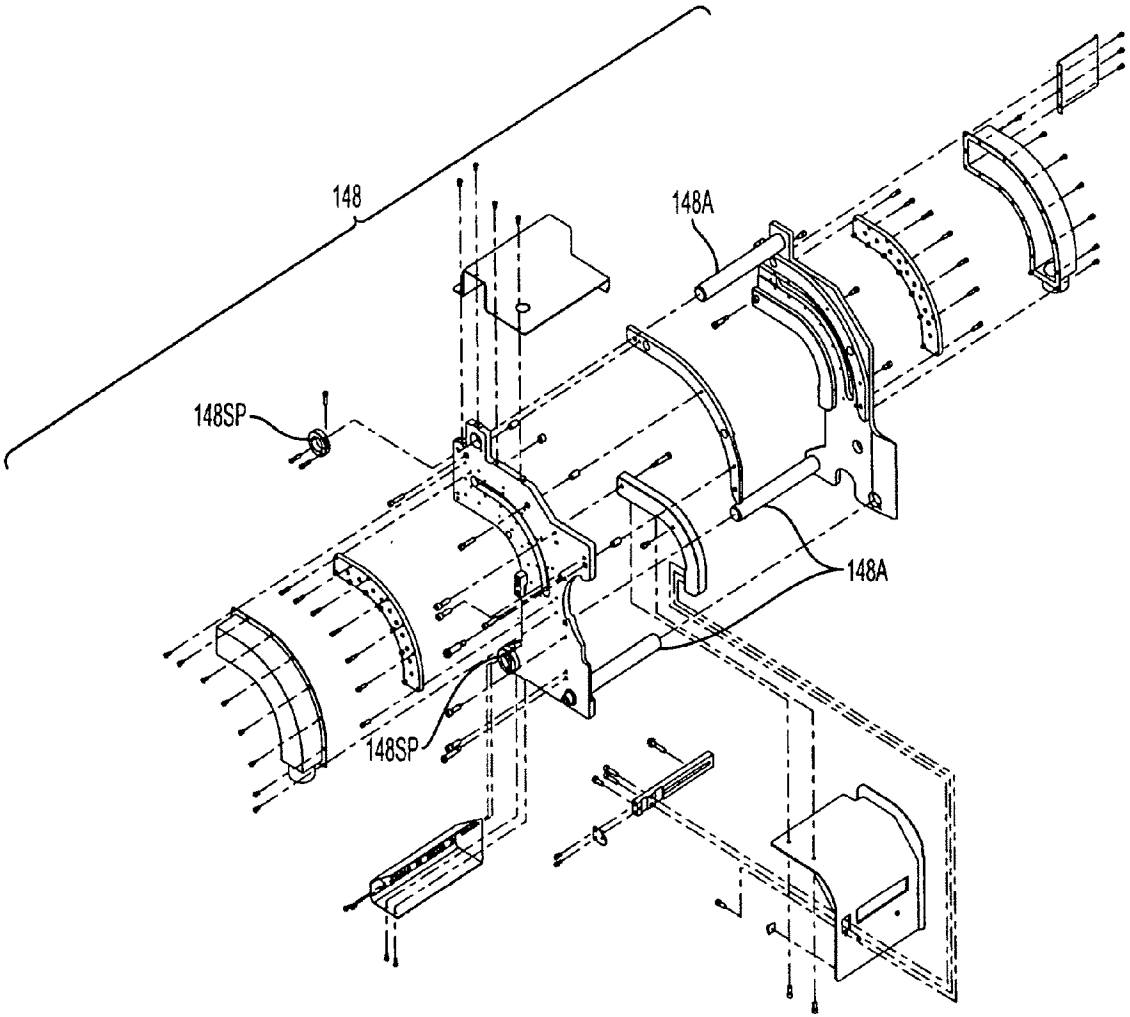
FIG. 30 is an exploded perspective view showing the can discharge arrangement depicted in FIGS. 26 to 29.

Each of the turret starwheels 142 are formed as two separate elements or "segments" 142A, 142B (see FIGS. 18 and 19 for example). Each segment is formed in two hemi-circular halves (see FIGS. 18 and 20 by way of example) so that they can be disposed in position on the turret drive shaft 120 in the manner shown in FIG. 3 for example. Each of segment 142A, 142B is connected with one of the turrets 112, 114 such that the outboard segment 142A is movable with the movable turret 112 so that the distance between the two segments 142A, 142B is adjusted as the distance between the two turrets 112, 114 is adjusted. This eliminates the need to disconnect one starwheel and replace it with another in the event that the change in can length demands the same. Of course, in the case of a change in diameter, different segments will need to be swapped out for others wherein the can receiving recesses or pockets are more appropriately dimensioned.

One of the two segments 142A and 142B of each of the turret starwheels 142 (in this case each of the segments 142A, which is supported on the adjustable turret 112 end), is connected to the drive shaft by way of a timing plate 144 (see FIGS. 3, 4, 16 and 17 for example). These timing plates 144 are individually adjustable with respect to the respective turret drive shaft 120 in a manner which allows their angular rotational position with respect to the turret drive shaft 120 to be adjusted and then fixed to the degree that the two segments 142A, 142B of the turret starwheel 142 which are mounted thereon, are positioned/timed with respect to the transfer starwheels 140 on either side thereof, so that a smooth, continuous, incident-free transfer of cans between the turret starwheels 142 and the respective transfer starwheels 140, can take place. Once the desired positional/timing requirements are achieved, the timing plates 144 can be locked in position so that any subsequent starwheel segment, which is mounted by way of the timing plates 144, will assume exactly the same position as its predecessor and thus eliminate any need for time consuming retiming operations to be carried out.

This, of course, requires that each of the mounting stud receiving bores in each of the starwheels be drilled/formed in exactly the position. However, once the timing plates 144 are all set to synchronize the respective starwheels with respect to one another, the need to repeat this set up is obviated and any subsequent change from one run to another is facilitated as a result.

The above type of timing plate 144, is used to mount each of the transfer starwheels 140 to the ends of the transfer drive shafts 138. However, in this case, the transfer starwheels 140, while also being formed of two segments 140A and 140B, are such that the segments are configured to be snugly connected to one another. The first or base segment 140A of each transfer starwheel 140 is mounted on the timing plate 144 while the second portion or segment 140B is secured to the first portion 140A. This allows for a second segment 140B, having the appropriate width, to be selected from a plurality of second segments (each of which have a different width) in a manner wherein the total width of the complete transfer starwheel 140 can be set in accordance with the length of the can which is to undergo necking.

The above construction also pertains the first transfer starwheel 140'.

As noted above in connection with the first transfer starwheel 140', the transfer starwheels 140 are arranged to hold the cans in position using suction. However, in order to stably hold longer cans in position with the above two-part type transfer starwheels, it is necessary to lengthen a channel, formed at the bottom of each of the can receiving recesses, in accordance with the change in width of the transfer starwheel. This channel, in effect acts in a manner similar to an "octopus sucker."

The disclosed transfer starwheel embodiments achieve this requirement by simply providing portions 140C1, 140C2 of the channel in both of the first and second segments 140A, 140B of each of the transfer starwheels 140', 140. Thus, when the two segments 140A, 140B are secured together the channel portions 140C1, 140C2 register with one another and a complete elongated channel is formed. Thus, by having a vacuum port 140Vp formed in each of the first channel portions 140C1 and fluidly communicating each of these ports with a source of vacuum (negative pneumatic pressure) via a suitable manifold 146, the vacuum which is supplied into the first channel portions 104C1 is delivered instantly into the second portions 140C2 and the surface area of the cans which are exposed to the suction, is increased to the degree that it is stably held in position as it passes below the transfer starwheel axis of rotation.

In the case of a short can, the second segment 140B can approximate a flat plate which closes the end of the channel portions 140C1.

FIGS. 21-30 show details of embodiments of can infeed and can discharge arrangements which find application with the above described structure in order to quickly reconfigure the machine line for a different size can. In order to quickly reconfigure the can infeed 104 and can discharge 148, the disclosed embodiments of these structures are such that they are formed in two halves so that at least one half can be moved relative to the other. The halves, in the disclosed embodiments are such as to be mutually supported on one another by way of three shafts 104A, 148A. The halves of the can infeed 104 and can discharge 148 can be constructed (merely by way of example) in the manner depicted in the exploded views shown in FIGS. 25 and 30.

As will be appreciated from the figures showing these embodiments, one end of each of the shafts is connected to a frame half while the other is configured to slide through a split collar which is fastened to a half. The collars comprise split collars 104SP having one portion fastened to a housing/structural member of the two housing halves. By releasing the collars, the two housing halves can be slid along the shafts 104A. 148A until the separation is suitable for the length of the can which is to be fed into/discharged from the machine line 102. Simply retightening the split collars SP locks the can infeed and can discharge structure in a suitable condition for feeding the cans into and out of the line.

Figure 35:
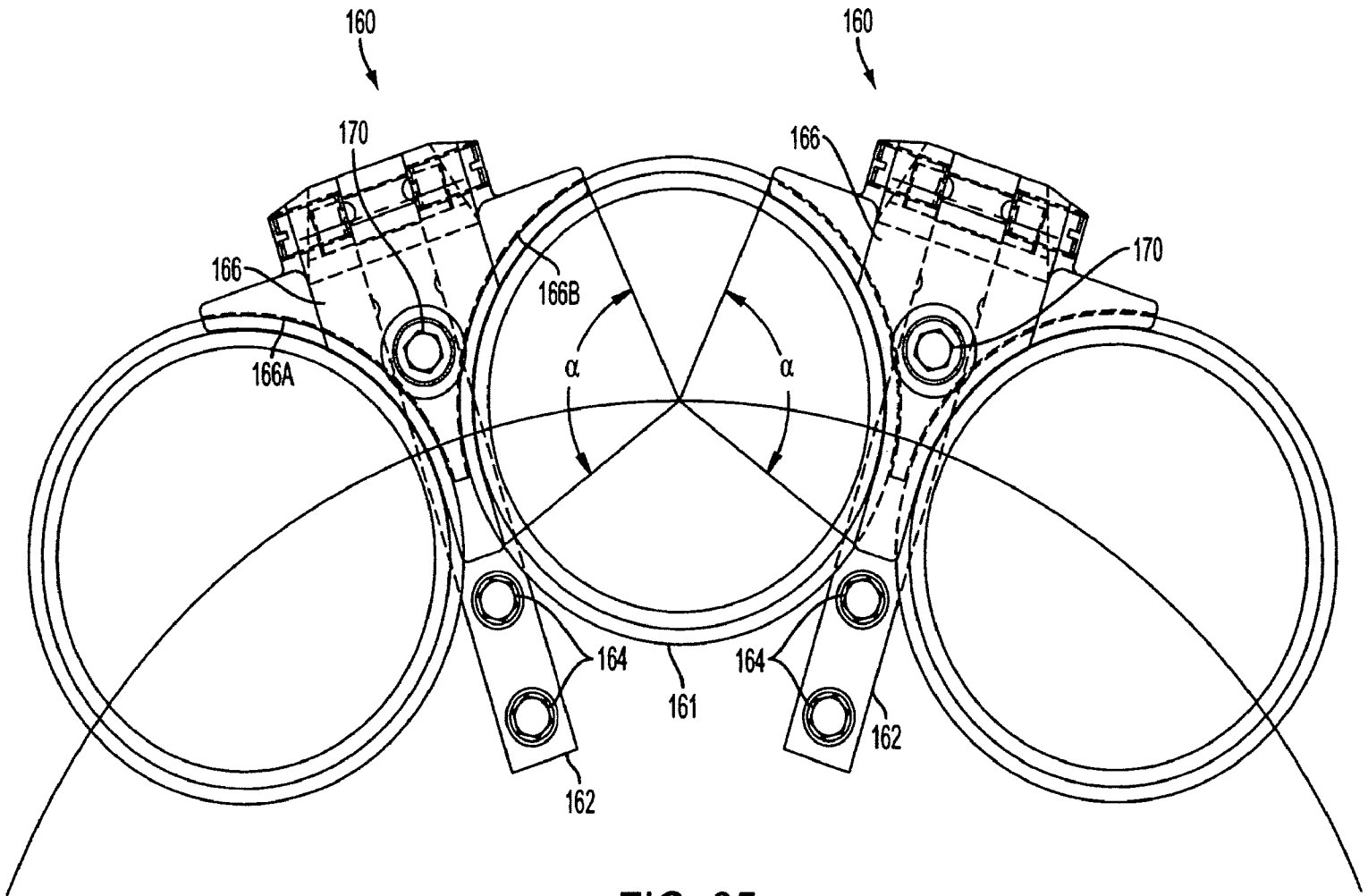
FIG. 35 is a front elevation of showing the pivotal clamps secured in a clamping position and showing sectors of the dies which are engaged by the clamps.

A further quick change enabling embodiment, resides in a clamp 160 which facilitates changing of the dies 161 on each of the die and knockout ram arrangements 116. In this embodiment, the die and knockout ram arrangements 116 are configured so that the dies 161 can slid into place and are free of screw threads and the like. FIGS. 33-37 depict embodiments of clamps 160 which facilitate clamping and release of the dies in an operative position. In a preferred embodiment, the clamps comprise a bracket 162 which is fastened to the die block 129 such as bolts 164. A pivotal member 166 is pivoted at one end of the bracket 162 and provided with a pair of arcuate clamping surfaces 166A and 166B which, as shown in FIG. 35, configured to engage a periphery of a predetermined sector (alpha) on two adjacent dies. Inasmuch as each die is retained in place by the clamps on either side thereof, the dies are adequately secured in place.

Figure 33:
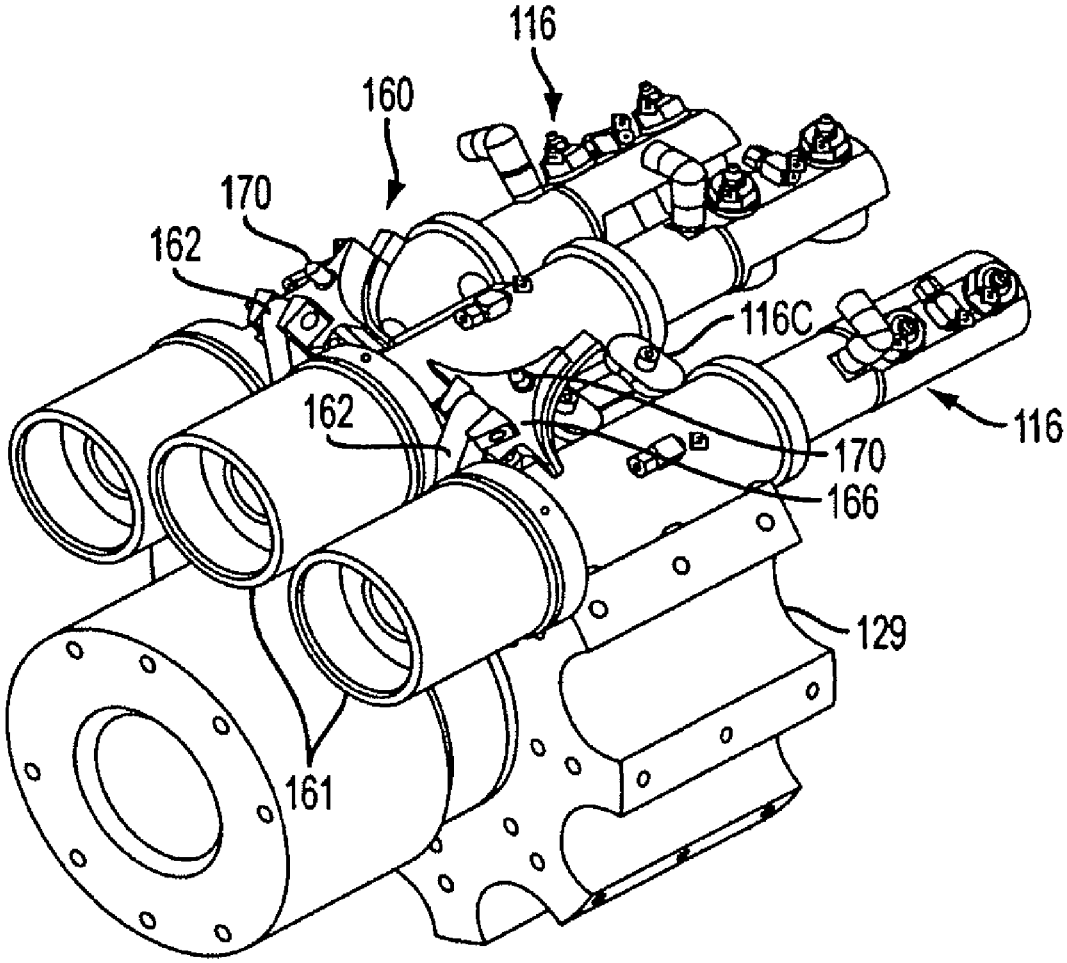
FIG. 33 is a perspective view showing an embodiment of a pivotal clamp/die arrangement which is used in accordance with an embodiment of the invention, and which shows the clamps pivoted back to an open, non-clamping position wherein the dies can be slipped off and replaced with new dies.
Figure 34:
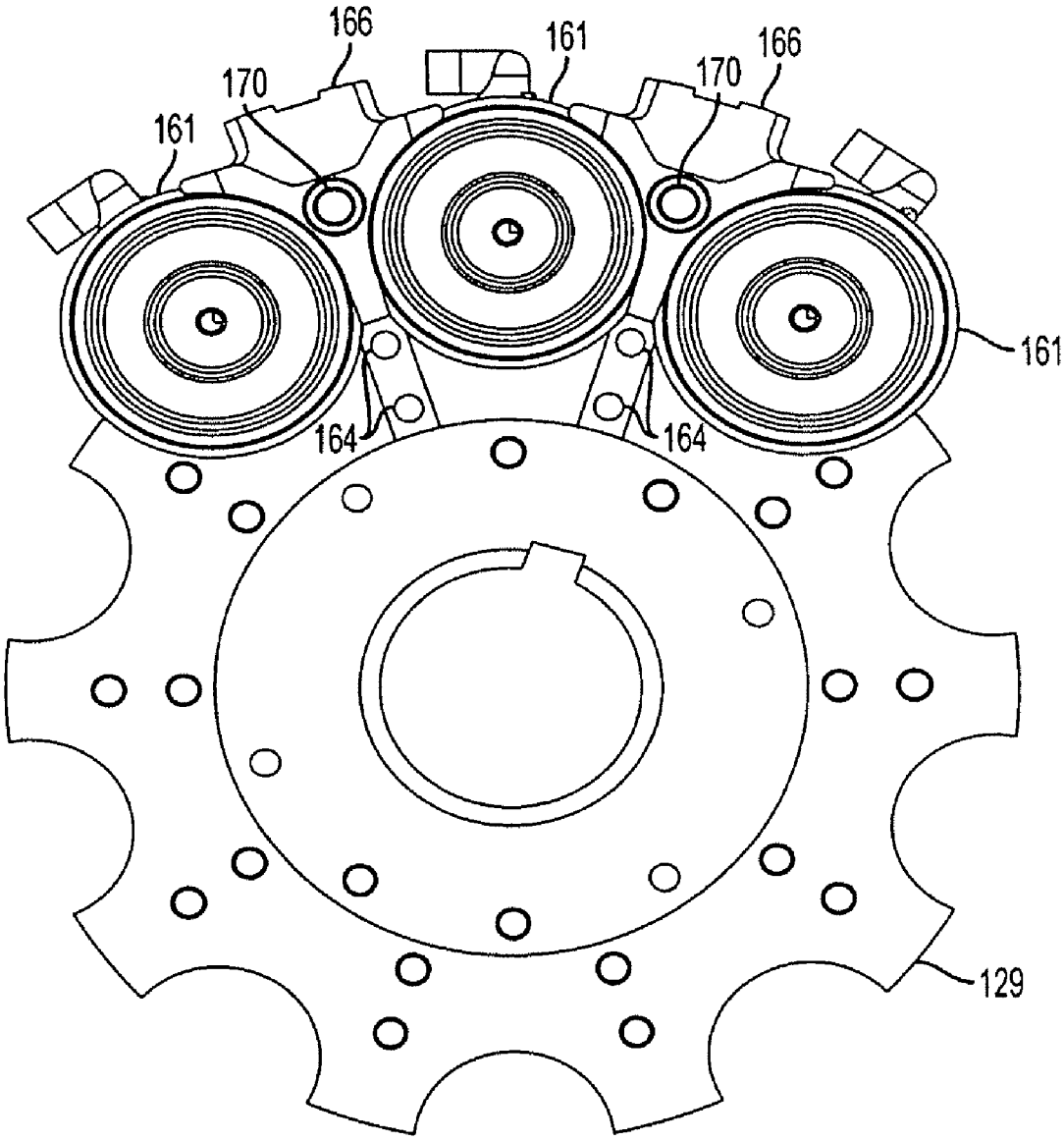
FIG. 34 is a font elevation of the arrangement shown in FIG. 33 depicting the pivotal clamps secured in their clamping positions.
Figure 37:
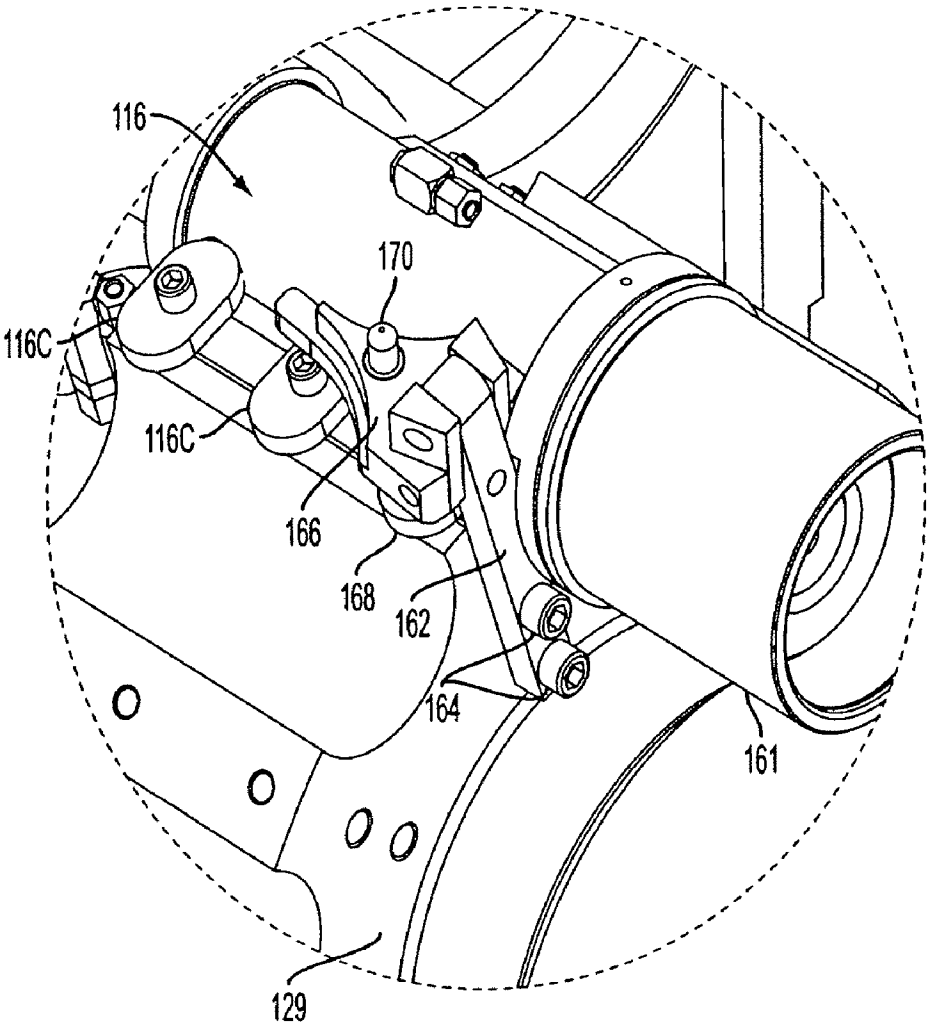
FIG. 37 shows the structure which is enclosed in the circle denoted by the letter A in FIG. 2 and depicts the manner in which die and knockout ram units are secured to a die block, along with the manner in which an example of a clamp mounting bracket, which forms part of the clamp embodiments shown in FIGS. 35 and 36, is secured to the die block.

With the pivotal embodiment of the clamp 160, the pivotal members 166 can be flipped back to positions such as shown in FIGS. 33 and 37. This moves the pivotal member 166 out of the way leaving adequate access to the dies 161 which are to be removed/replaced.

As will be appreciated from FIG. 1, only a limited number of dies 161 at the tops of each turret are accessible at any one time. The remaining dies rendered inaccessible due to obstruction by the transfer wheels which handle the cans. As a result, it is necessary to release and remove the dies 161 which are accessible and then jog the machines to rotate more dies 161 into an accessible position. However, the rotation of the turrets during this jogging moves the clamps to positions wherein they are exposed to gravitational forces which tend to cause the pivotal members 166 to swing out to a position wherein they extend essentially normally to the axis of rotation. This can induced damage either to the clamps or to structure they engage in response to subsequent jogs.

Accordingly, a detent or click stop 168 (see FIG. 37) is provided on each of the clamps to hold the pivotal members 166 in the positions shown in FIGS. 33 and 37 during this rotation.

In the illustrated embodiment, the pivotal member 166 are each held in place by a single bolt 170. This is placed in a position to readily tightened/loosened using a power tool. However, due to the pivotal nature of the pivotal member, as the bolt approaches the threaded bore (see FIG. 37) in which it is to be received, it approaches at an angle with respect to the bore and is not parallel to the axis of the bore. Accordingly, the bore in which the bolt is retained in each of the clamps, is configured to allow pivotal motion of the bolt in addition to the normal rotation. That is to say, the bolt is arranged to be pivotal through an angle which lies on a plane normal to the axis about which the pivotal member is pivotal. Thus, when the pivotal member is swung down toward a clamping position an operator can, using the power tool which is used to rotate the bolt, engage the bolt and easily tilt it so that it aligns with the bore and quickly screw the bolt into place.

Figure 36:
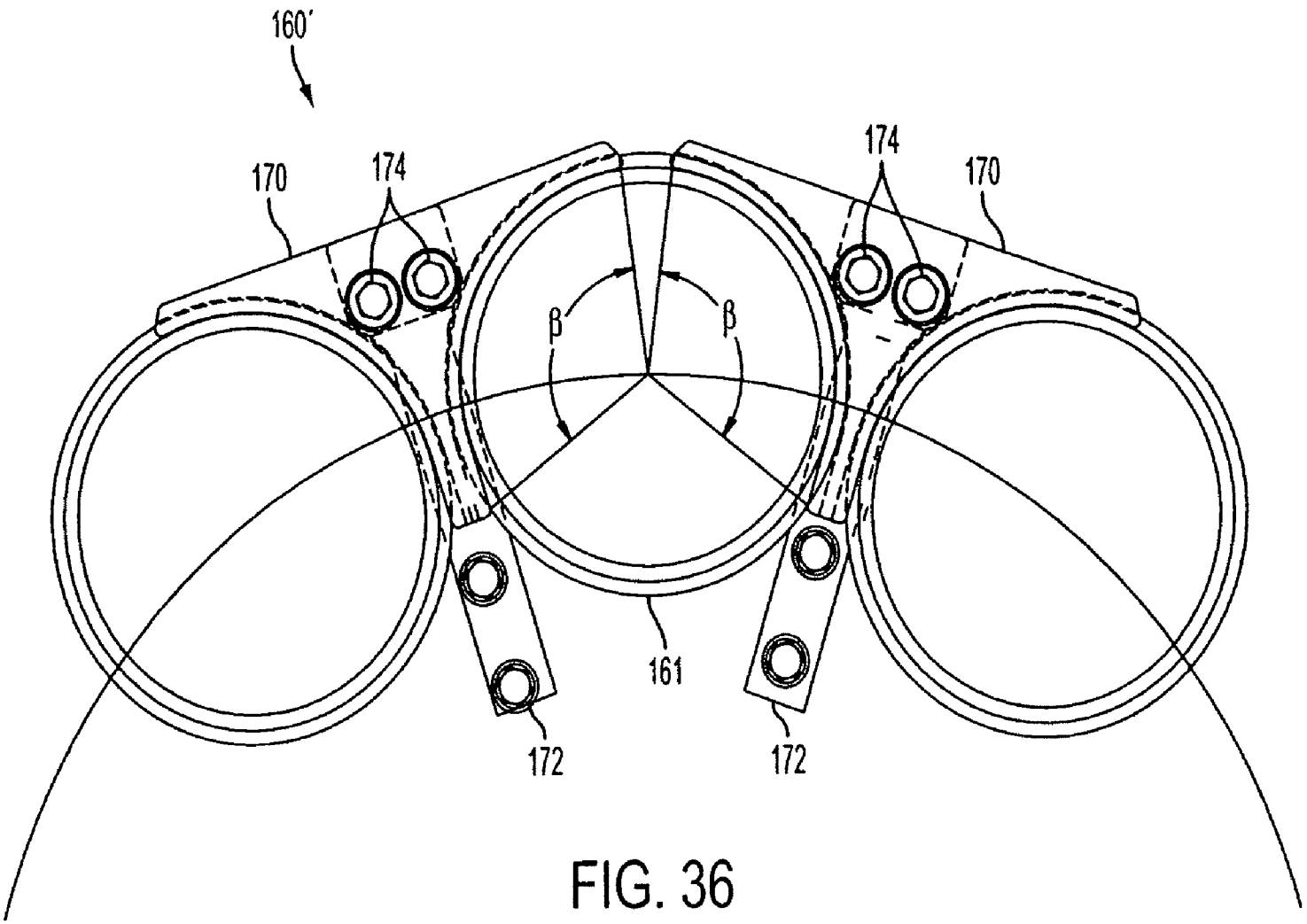
FIG. 36 is a front elevation showing a second clamp embodiment which is configured to be completely removable when securing bolts are loosened.

FIG. 36 shows a second clamp embodiment. In this embodiment, the clamps 160' have clamping members 170 which are secured to the brackets 172 by bolts 174 and are removable from the brackets 172 upon removal of the bolts 174.

Figure 38:
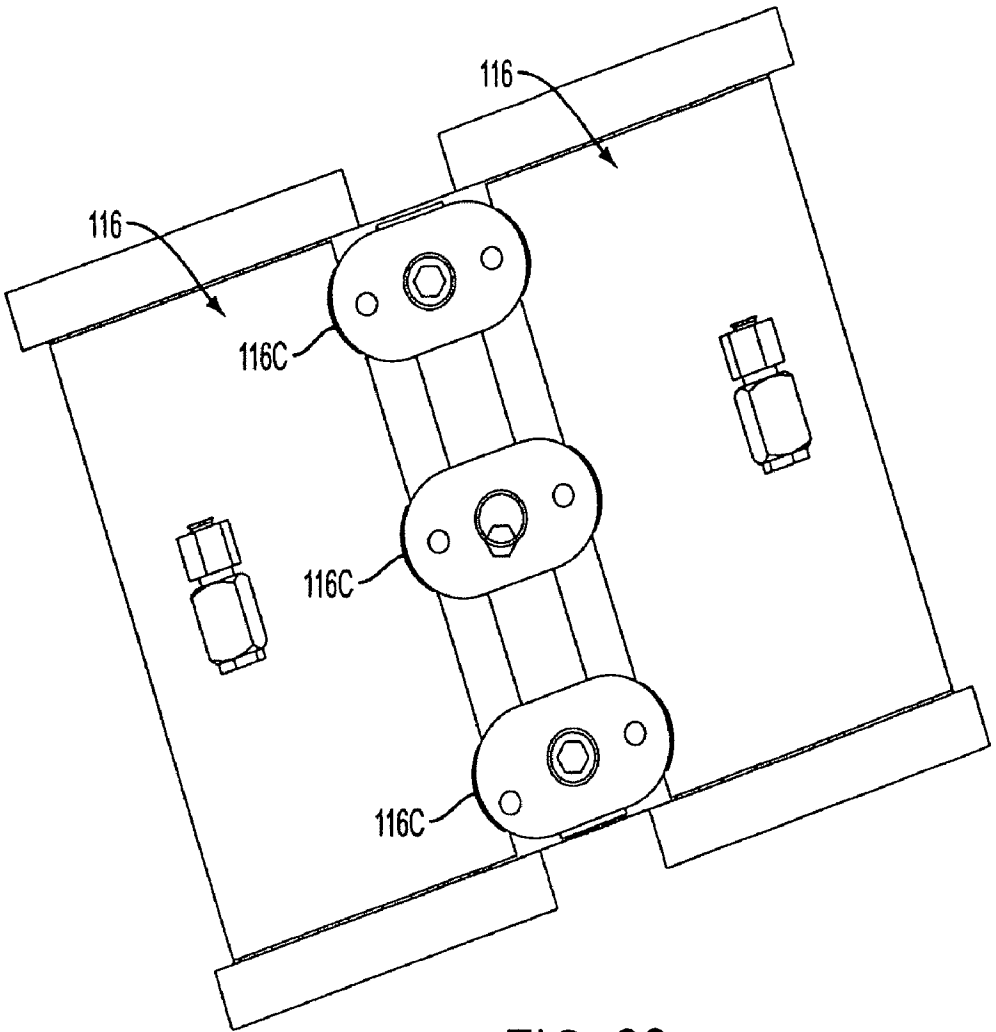
FIGS. 38 and 39 are respectively plan and sectional elevations showing details of an embodiment, via which the die and knockout ram units are secured to the die block.
Figure 39:
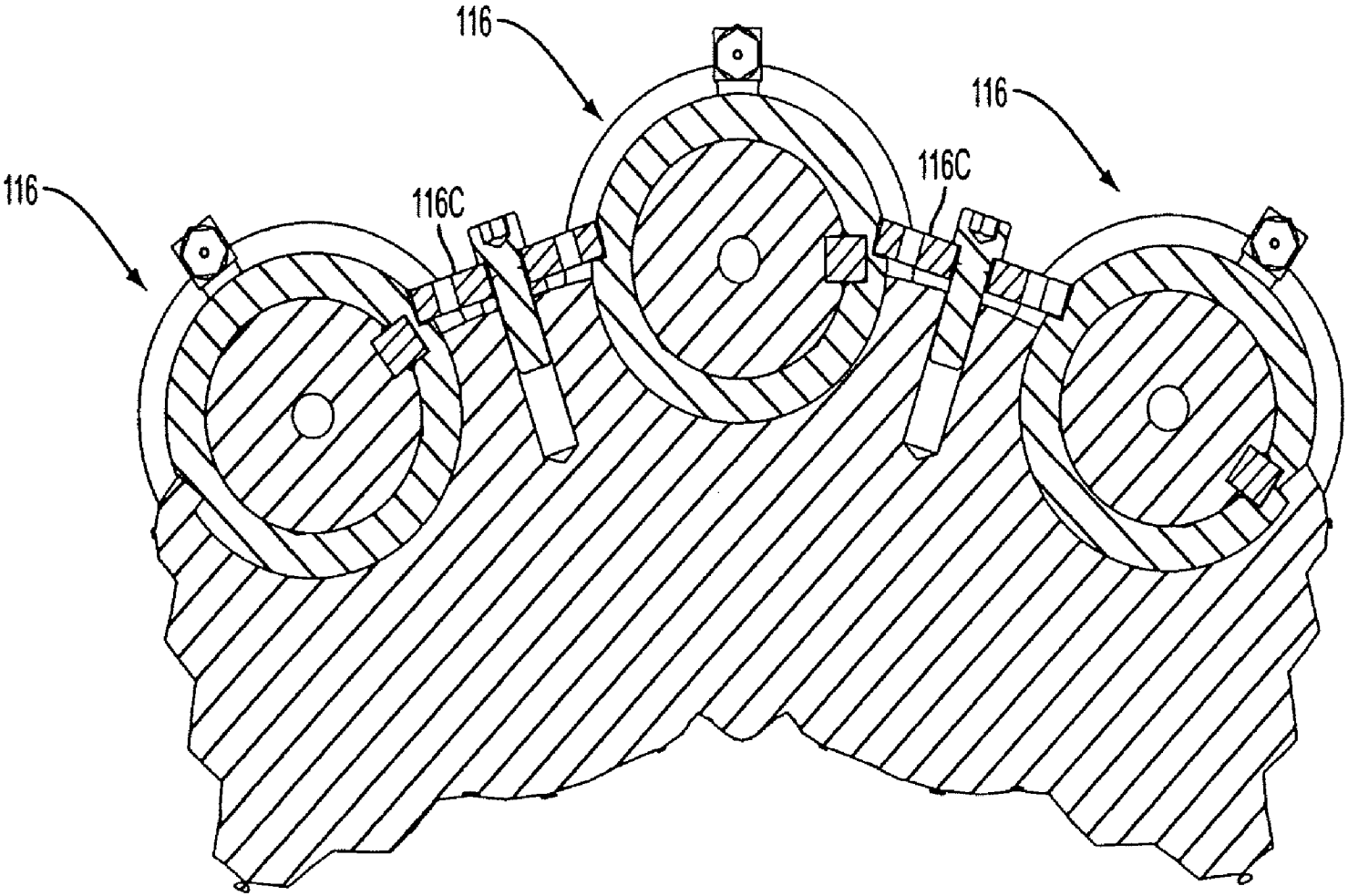

FIGS. 38 and 39 show clamp arrangements 116C which are used to hold the die and knockout ram 116 in position on the die block 129. As will be appreciated simply loosening and removal of clamps 116*c* and die clamp assembly 160, allows ready removal/replacement of a die and knockout ram unit should it be necessary.

Returning now to FIGS. 3 and 4, since the movable turret 112 is movable, in order to maintain a constant supply of lubricant to the devices which are mounted on the mounting block (128)—i.e. the push plate and ram arrangements 116 (FIG. 3) and the process rams 118 (FIG. 4), an embodiment of the invention is such that a coaxial bore formed along the turret drive shaft supplies lubricant to a port formed in the shaft. A helical tube is disposed about the turret drive shaft and connected at one end to the port. The other end of the helical tube is connected with the apparatus mounted on the support block and thus enable a constant supply of lubricant irrespective of the position in which the movable turret is set.

Figure 5:
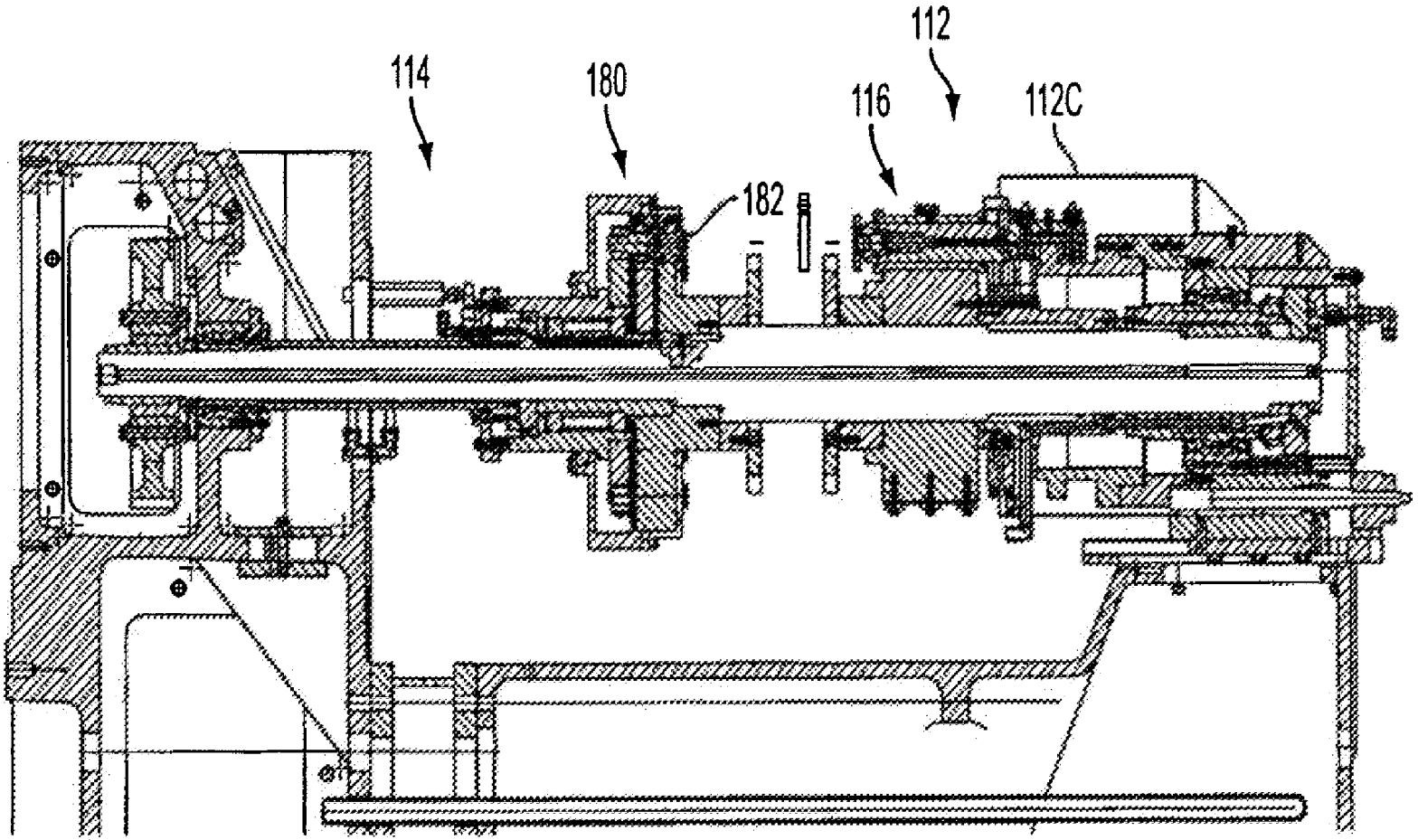
FIG. 5 is a side sectional view showing an embodiment of a turret wherein flanging arrangements are carried on the stationary or non-repositionable turret and suction equipped push plate and ram arrangements are carried on the repositionable turret.
Figure 6:
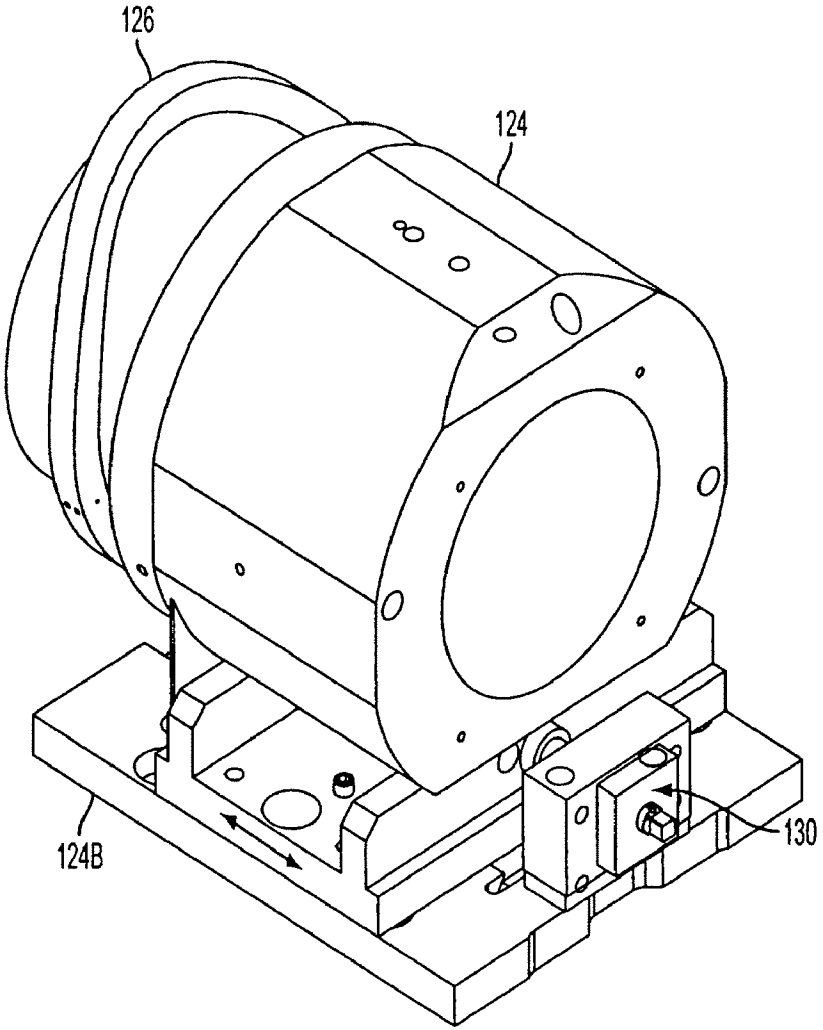
FIG. 6 is a perspective view showing a cam support and cam arrangement which forms part of an embodiment of the invention.
Figure 7:
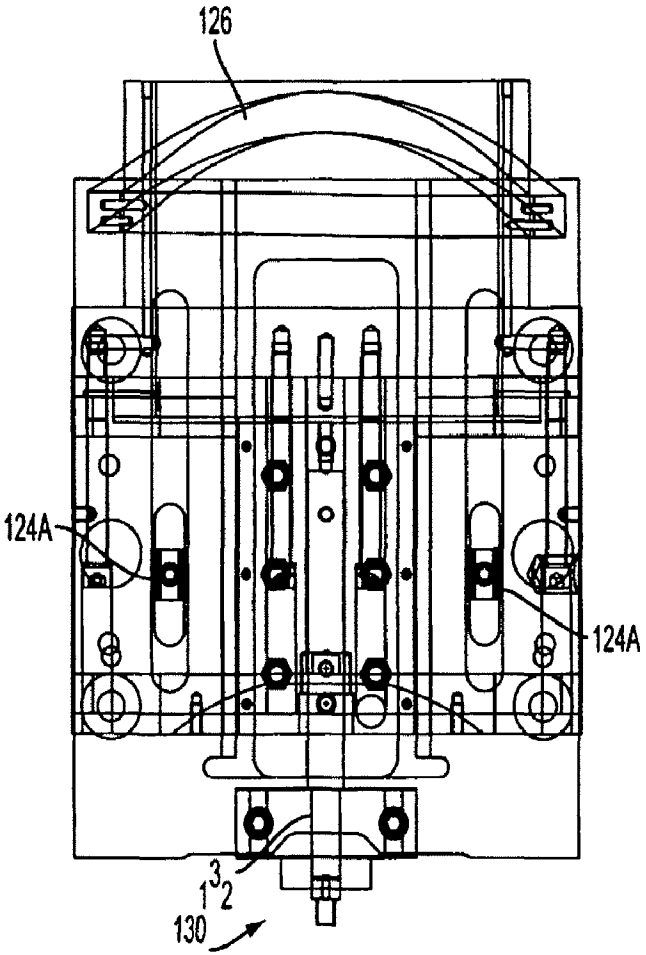
FIG. 7 is a top plan view of the cam support and cam arrangement shown in FIG. 6.
Figure 8:
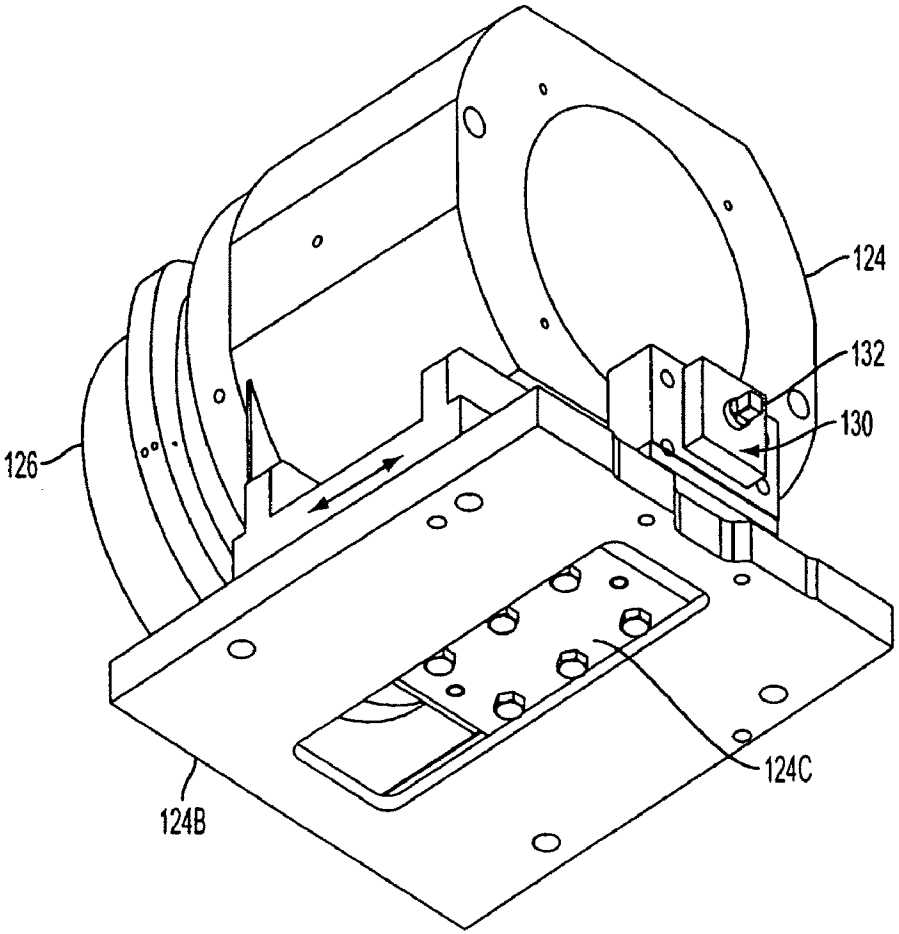
FIG. 8 is a perspective view showing underside of a cam support and cam arrangement according to an embodiment of the invention depicted in FIGS. 6 and 7.
Figure 9:
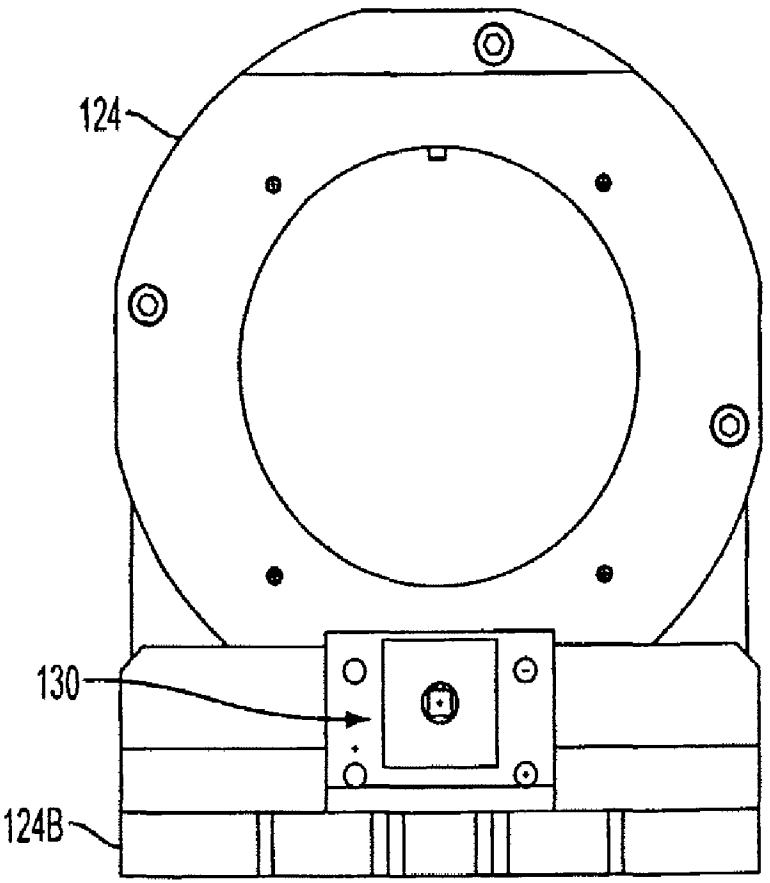
FIG. 9 is an end elevation showing an outboard face of the cam support shown in FIG. 6.
Figure 10:
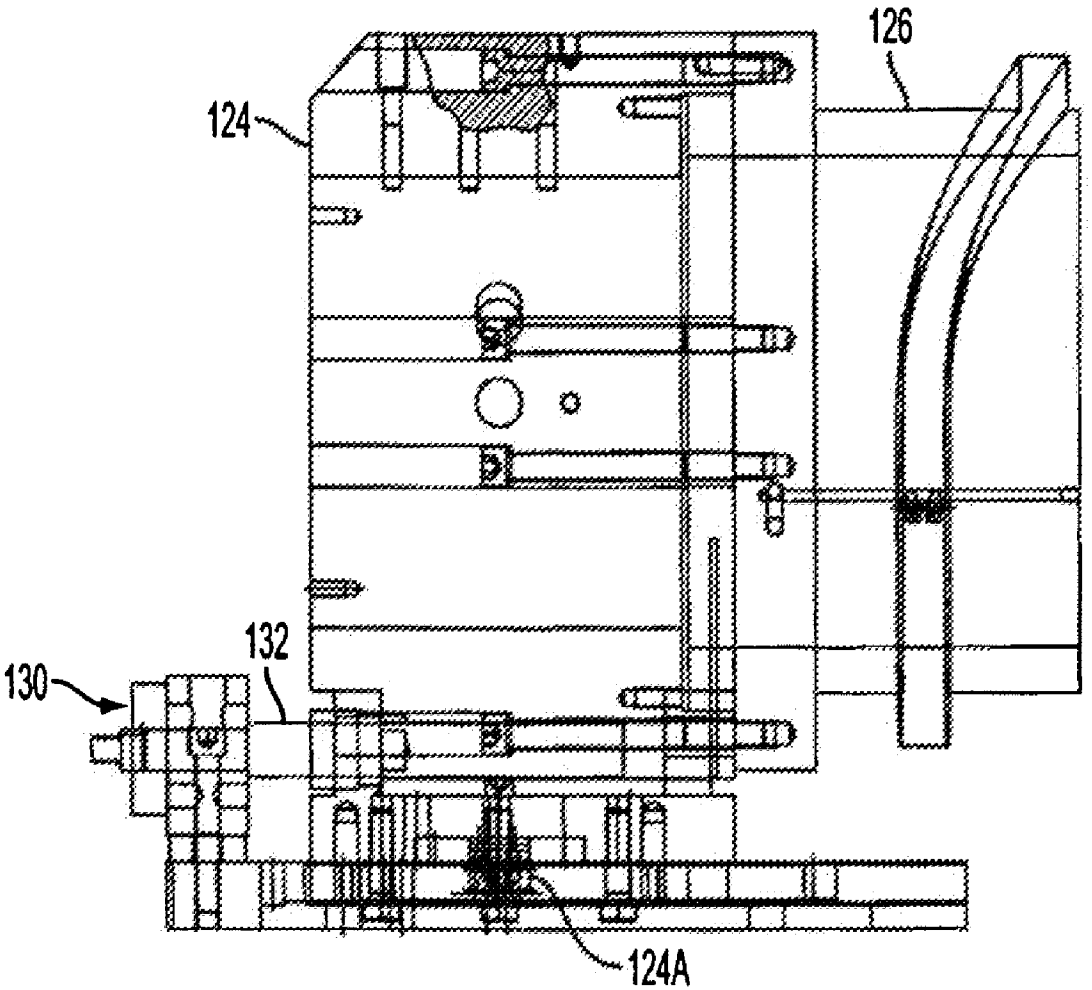
FIG. 10 is a side elevation of the cam support and cam arrangement shown in FIG. 6.
Figure 11:
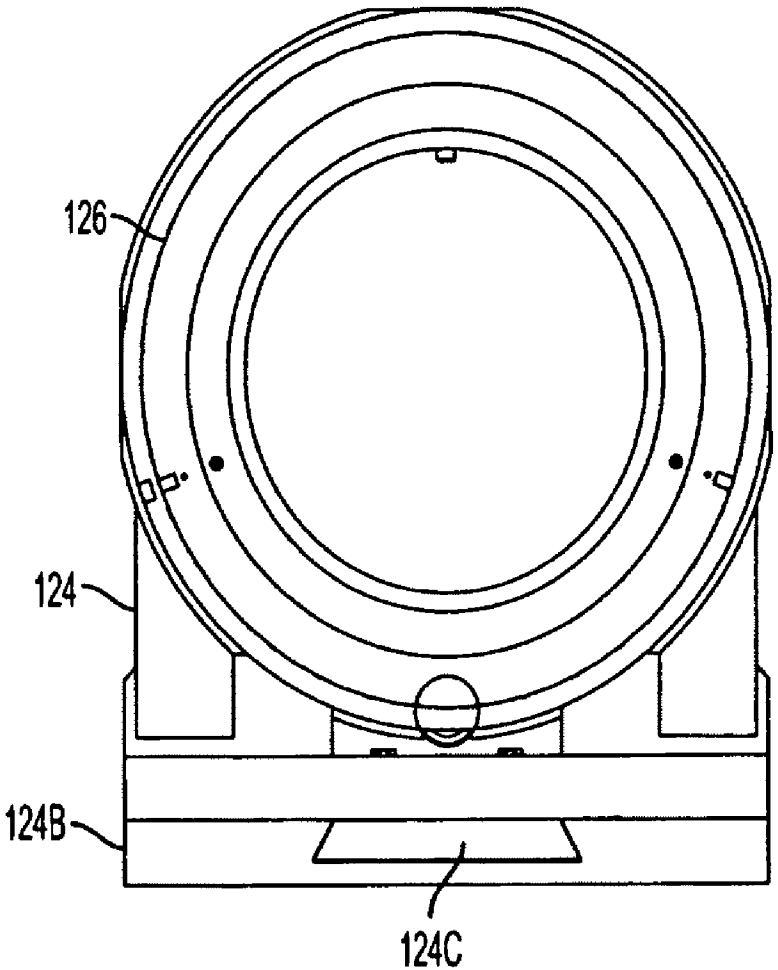
FIG. 11 is a front elevation showing an inboard face of the cam shown in FIG. 6.
Figure 12:
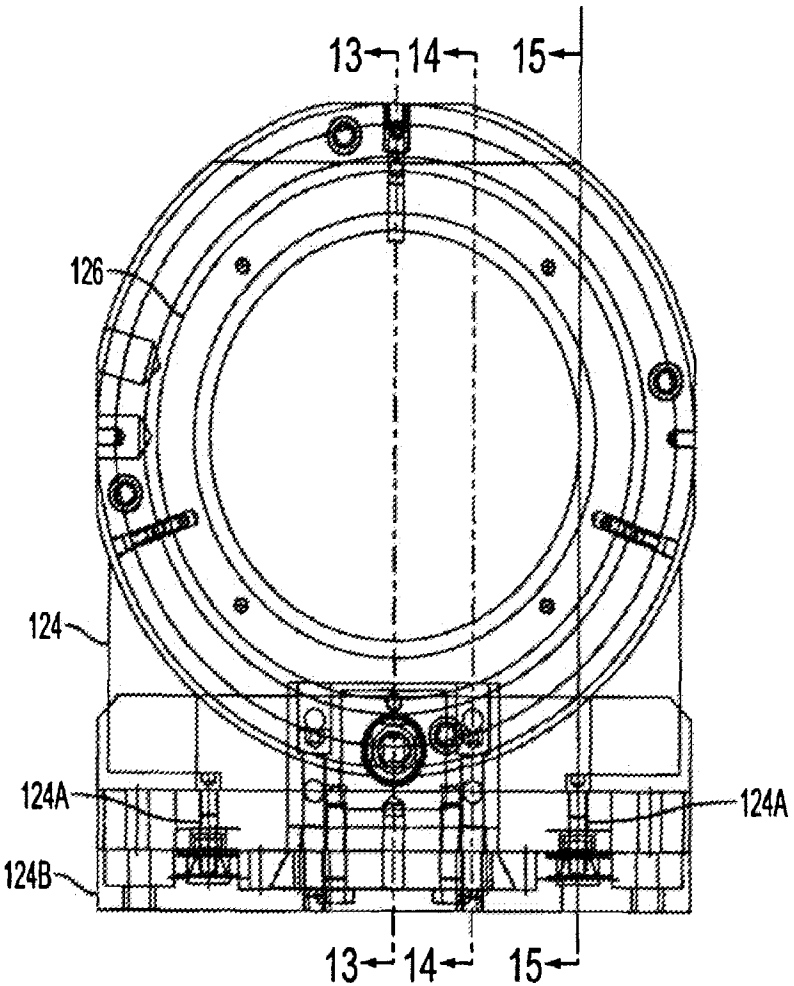
FIG. 12 is a side elevation similar to that shown in FIG. 11 depicting the manner in which subsequent sectional views are taken.
Figure 13:
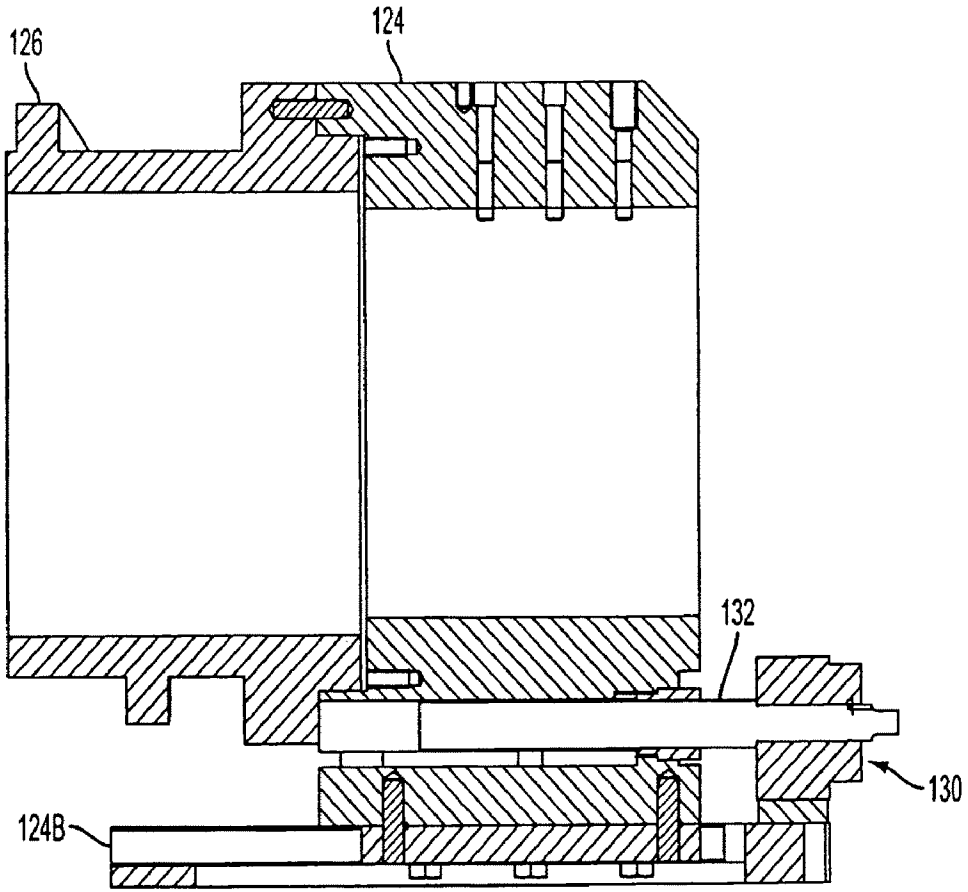
FIGS. 13-15 are sectional views taken along the respective section lines shown in FIG. 12.
Figure 14:
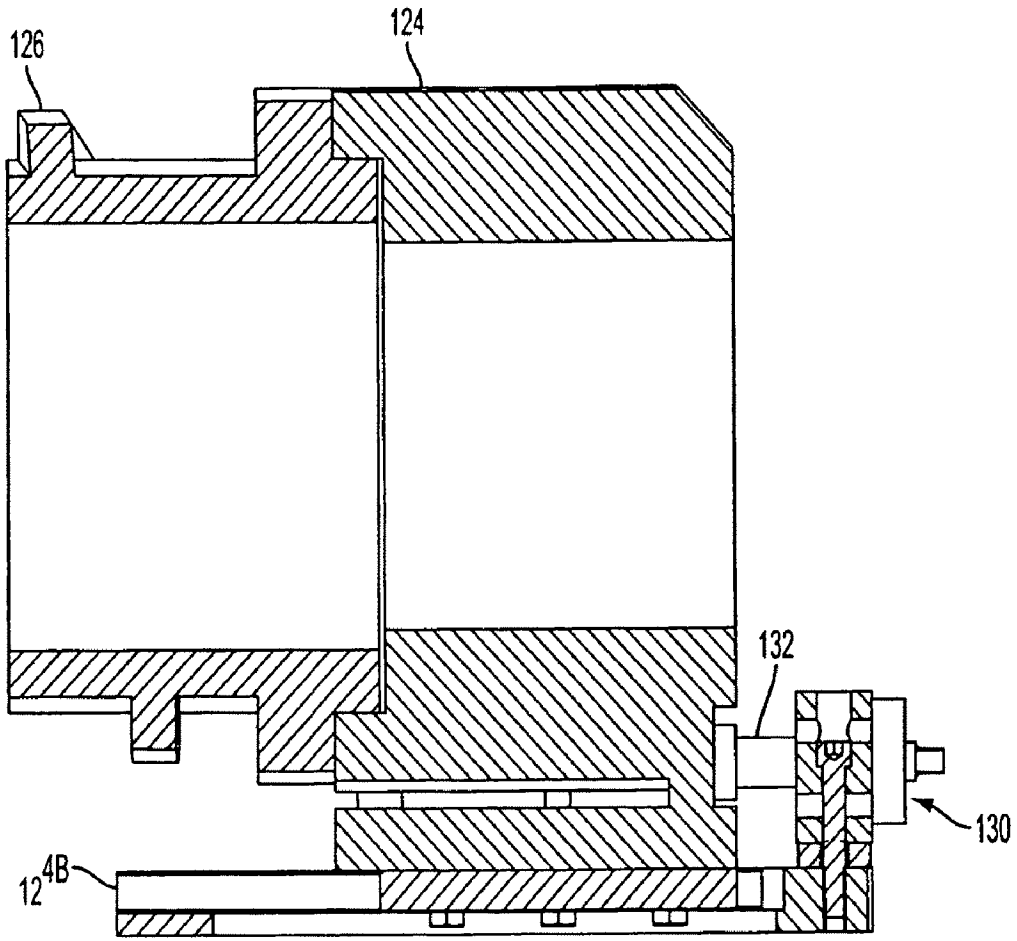

Referring now to FIG. 5, a spin flanging stage 180 is shown wherein the push plate and ram arrangements 116 are supported on the movable turret 112 and the spin flanging arrangements 182 are supported on the fixed turret 114. As shown in FIG. 1, assuming this to be last stage which is illustrated, a final transfer starwheel received the flanged cans and transfers them to the can discharge 148.

Although only a limited number of embodiments have been disclosed it is submitted that the various modifications and changes that can be made by those skilled in the art to which the claimed subject matter pertains, or most closely pertains, when equipped with this disclosure, will be essentially self evident, and that the scope of the invention is limited only by the appended claims.

What is claimed is:

1. A method of changing a can necking machine line from a first can necking set up to a different can necking set up wherein the machine line comprises machines having a first turret which supports one of push plate plus ram arrangements and die plus knockout ram arrangements and a second turret which supports the other of the push plate and ram arrangements and die and knockout ram arrangements comprising:

securing the dies of the die and knockout ram arrangements in position by:

sliding each die into an operative position;

pivoting a clamp from an open position to a clamping position that engages at least one die, the clamp being pivotally supported at one end thereof; and securing the clamp to a mounting bracket.

2. A method as set forth in claim 1, further comprising securing the clamp to the mounting bracket using a bolt.

3. A method as set forth in claim 1, further comprising:

holding the clamp in the open position using a detent.

4. A method as set forth in claim 3, wherein the pivoting step comprises clamping each of a pair of arcuate clamping surfaces on the clamp to engage a periphery of a different die.

5. A method as set forth in claim 1, wherein the pivoting step comprises clamping each of a pair of clamping surfaces on the clamp to engage a periphery of a different die.

6. A method of changing a can necking machine line from a first can necking set up to a different can necking set up wherein the machine line comprises machines having a first turret which supports one of push plate plus ram arrangements and die plus knockout ram arrangements and a second turret which supports the other of the push plate and ram arrangements and die and knockout ram arrangements comprising:

securing the dies of the die and knockout ram arrangements in position by:

sliding each die into an operative position;

pivoting a clamp from an open position to a clamping position that clamps each of a pair of arcuate clamping surfaces on the clamp to engage a periphery of at least one die, the clamp being pivotally supported at one end thereof; and securing the clamp to a mounting bracket.

7. A method as set forth in claim 6, further comprising:

holding the clamp in the open position using a detent.

8. A method as set forth in claim 6, wherein the clamp engages the periphery of two dies.

* * * * *